US010906092B2

(12) United States Patent
Sakaguchi et al.

(10) Patent No.: US 10,906,092 B2
(45) Date of Patent: Feb. 2, 2021

(54) FLASKLESS MOLDING MACHINE

(71) Applicant: SINTOKOGIO, LTD., Nagoya (JP)

(72) Inventors: Koichi Sakaguchi, Toyokawa (JP); Tokiya Terabe, Toyokawa (JP); Tatsumi Fujita, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 267 days.

(21) Appl. No.: 16/301,797

(22) PCT Filed: May 12, 2017

(86) PCT No.: PCT/JP2017/018064
§ 371 (c)(1),
(2) Date: Nov. 15, 2018

(87) PCT Pub. No.: WO2017/199880
PCT Pub. Date: Nov. 23, 2017

(65) Prior Publication Data

US 2019/0160525 A1 May 30, 2019

(30) Foreign Application Priority Data

May 17, 2016 (JP) ..... 2016-098755

(51) Int. Cl.
*B22C 11/00* (2006.01)
*B22C 15/28* (2006.01)
(Continued)

(52) U.S. Cl.
CPC ..... *B22C 11/00* (2013.01); *B22C 9/02* (2013.01); *B22C 15/02* (2013.01); *B22C 15/06* (2013.01);
(Continued)

(58) Field of Classification Search
CPC ..... B22C 11/10; B22C 15/08; B22C 15/24; B22C 15/28; B22C 19/04
See application file for complete search history.

(56) References Cited

U.S. PATENT DOCUMENTS 4,840,218 A 6/1989 Hunter
5,246,058 A * 9/1993 Murata ..... B22C 11/10 164/182
2004/0206472 A1* 10/2004 Hirata ..... B22C 15/24 164/456

FOREIGN PATENT DOCUMENTS

CN 1418308 A 5/2003
CN 101862815 A 10/2010
(Continued)

OTHER PUBLICATIONS

International Preliminary Report on Patentability dated Nov. 29, 2018 for PCT/JP2017/018064.

*Primary Examiner* — Kevin E Yoon
*Assistant Examiner* — Jacky Yuen
(74) *Attorney, Agent, or Firm* — Faegre Drinker Biddle & Reath LLP

(57) ABSTRACT

A flaskless molding machine includes: an upper flask; a lower flask; an upper sand tank; an upper plate attached to a lower end of the upper sand tank; a first lower sand tank; a second lower sand tank; a lower plate attached to an upper end of the second lower sand tank; a drive unit performing squeezing using the upper plate and the lower plate; an adjustment drive unit moving the first lower sand tank; a first detector detecting a height position of the first lower sand tank; a second detector detecting a height position of the second lower sand tank; and a control unit operating the drive unit and the adjustment drive unit so that the height positions of the first communication port and the second
(Continued)

communication port coincide with each other, based on detection results of the first detector and the second detector.

20 Claims, 33 Drawing Sheets

(51) Int. Cl.

| | |
|---|---|
| ***B22C 19/04*** | (2006.01) |
| ***B22C 15/06*** | (2006.01) |
| ***B22C 15/08*** | (2006.01) |
| ***B22C 15/02*** | (2006.01) |
| ***B22C 9/02*** | (2006.01) |

(52) U.S. Cl.
CPC ..... *B22C 15/08* (2013.01); *B22C 15/28* (2013.01); *B22C 19/04* (2013.01)

(56) References Cited

FOREIGN PATENT DOCUMENTS

| | | | |
|---|---|---|---|
| CN | 201799574 | U | 4/2011 |
| CN | 102834200 | A | 12/2012 |
| CN | 104128571 | A | 11/2014 |
| EP | 2433725 | A1 | 3/2012 |
| GB | 2059836 | A | 4/1981 |
| JP | S54-51930 | A | 4/1979 |
| JP | H8-300104 | A | 11/1996 |
| JP | H09-271897 | A | 10/1997 |
| JP | 2002-361368 | A | 12/2002 |
| JP | 2011-92964 | A | 5/2011 |
| JP | 2012-076116 | A | 4/2012 |
| WO | WO-2011/086712 | A1 | 7/2011 |
| WO | WO-2011/111241 | A1 | 9/2011 |
| WO | WO 2017/138161 | A1 | 8/2017 |

* cited by examiner

FLASKLESS MOLDING MACHINE

TECHNICAL FIELD

This disclosure relates to a flaskless molding machine.

BACKGROUND ART

Patent Document 1 discloses a flaskless molding machine that forms a flaskless type mold that does not have any flask. This molding machine includes: a pair of an upper flask and a lower flask that clamp a match plate where a model is disposed; a supply mechanism that supplies mold sand; and a squeeze mechanism that compresses the mold sand. The molding machine moves the lower flask close to the upper flask, and causes the upper flask and the lower flask to clamp the match plate. In this state, the molding machine operates the supply mechanism, thereby supplying mold sand into upper and lower molding spaces formed by the upper flask and the lower flask. The molding machine operates the squeeze mechanism, thereby compressing the mold sand in the upper and lower molding spaces. Through the process described above, an upper mold and a lower mold are simultaneously formed.

The supply mechanism of the molding machine supplies the mold sand to the upper and lower molding spaces using compressed air. The supply mechanism includes an upper sand tank that communicates with a compressed air source and stores mold sand, and an upper blow head that is disposed above the upper flask and statically communicates with the upper sand tank. The compressed air blown from the compressed air source supplies the upper blow head with the mold sand stored in the upper sand tank, and supplies the mold sand at the upper blow head to the upper molding space defined by the upper flask. Likewise, the supply mechanism includes a lower sand tank that communicates with the compressed air source and stores mold sand, and a lower blow head that is disposed below the lower flask, moves vertically, and communicates with the lower sand tank at a predetermined position. The compressed air blown from the compressed air source supplies the lower blow head with the mold sand stored in the lower sand tank, and supplies the mold sand at the lower blow head to the lower flask.

The squeeze mechanism of the flaskless molding machine includes an upper squeeze cylinder and a lower squeeze cylinder that vertically face with each other. The upper squeeze cylinder applies a downward pressure to the mold sand in the upper molding space, and the lower squeeze cylinder applies an upward pressure to the mold sand in the lower molding space. Accordingly, the hardness of the mold sand is increased.

CITATION LIST

Patent Document

Patent Document 1: Japanese Unexamined Patent Publication No. S54-51930

SUMMARY OF INVENTION

Technical Problem

In the flaskless molding machine described in Patent Document 1, since the thickness of the mold to be formed is changed according to the model shape and the CB (compactability) of the mold sand, the height of a target of the lower blow head is changed according to the thickness of the mold. Consequently, there is a possibility that the communication port of the lower blow head and the communication port of the lower sand tank deviate from each other in certain situations. In this case, the flow of the mold sand is not uniform. Accordingly, there is a possibility that sand clogging occurs in the lower sand tank. Such sand clogging can be avoided by using mold sand having a low CB. However, the mold sand adjusted to have a low CB is not the optimal mold sand with respect to the moldabilities of the molds and the qualities of casting products in some cases. In this technical field, a flaskless molding machine that forms excellent molds and casting products is desired.

Solution to Problem

A flaskless molding machine according to one aspect of the present invention is a flaskless molding machine forming a flaskless upper mold and lower mold, including: an upper flask; a lower flask disposed below the upper flask and capable of clamping a match plate with the upper flask; an upper sand tank disposed above the upper flask, communicating with a compressed air source, being open at a lower end thereof, and internally storing mold sand; an upper plate attached to a lower end of the upper sand tank, with at least one supply port being formed in the upper plate, the supply port allowing the upper sand tank to communicate with an inside of the upper flask; a first lower sand tank communicating with a compressed air source, internally storing mold sand, and having a first communication port for discharging the stored mold sand; a second lower sand tank disposed below the lower flask, being open at an upper end thereof, having a second communication port capable of communicating with the first communication port of the first lower sand tank, and storing the mold sand supplied from the first lower sand tank and to be supplied into the lower flask; a lower plate attached to an upper end of the second lower sand tank, with at least one supply port being formed in the lower plate, the supply port allowing the second lower sand tank to communicate with an inside of the lower flask; a drive unit configured to move the second lower sand tank in a vertical direction, and allowing the upper plate and the lower plate to perform squeezing; an adjustment drive unit configured to move the first lower sand tank in the vertical direction; a first detector configured to detect a height position of the first lower sand tank; a second detector configured to detect a height position of the second lower sand tank; and a control unit configured to operate the drive unit and the adjustment drive unit so that the height positions of the first communication port and the second communication port coincide with each other, based on detection results of the first detector and the second detector.

The flaskless molding machine allows the control unit operating the adjustment drive unit to adjust the height of the first communication port of the first lower sand tank in such a way to coincide with the height of the second communication port of the second lower sand tank. Accordingly, the flow of mold sand at the communication portion between the first communication port and the second communication port becomes uniform, and occurrence of sand clogging can be suppressed. Consequently, the need to adjust the CB of mold sand in consideration of sand clogging is negated. The mold sand optimal to the moldability of a mold and the quality of a casting product can be used. Resultantly, the excellent mold and casting product can be obtained.

In one embodiment, an upper molding space for molding the upper mold may be formed by the upper plate, the upper flask and the match plate, and the upper molding space may be filled with the mold sand stored in the upper sand tank, through the upper plate, and a lower molding space for molding the lower mold may be formed by the lower plate attached to the second lower sand tank moved by the drive unit to a predetermined height, the lower flask and the match plate, a height of the first communication port of the first lower sand tank may be adjusted by the adjustment drive unit to a communication position of the second communication port of the second lower sand tank to supply the mold sand stored in the first lower sand tank to the second lower sand tank, and the lower molding space may be filled with the mold sand stored in the second lower sand tank, through the lower plate, and in a state where the upper molding space and the lower molding space are filled with the mold sand, the drive unit may move the second lower sand tank upward to perform squeezing between the upper plate and the lower plate.

In such a configuration, only the divided second lower sand tank is vertically moved, thereby allowing mold sand filling and squeezing to be achieved at the lower flask. Consequently, in comparison with a case where an integral sand tank for the lower flask is adopted, the inclination due to a load imbalance can be reduced.

The flaskless molding machine according to one embodiment, may include a lower filling frame, wherein the lower molding space may be formed by the lower plate, the lower flask, the lower filling frame and the match plate. In such a configuration, the stroke of the lower flask can be short. Consequently, the flaskless molding machine can be a molding machine having a low machine height in comparison with a case without the lower filling frame, and the molding time of the pair of the upper mold and the lower mold can be reduced.

In one embodiment, the upper sand tank and the first lower sand tank may be provided with permeation members each having a plurality of pores on an inner surface thereof, the pores allowing the compressed air to flow. In such a configuration, the compressed air is supplied to a storage space from the side through the entire surfaces of the permeation members. Consequently, the fluidity of mold sand is improved. In this state, the mold sand is then blown into the upper flask or the lower flask by the compressed air, thereby allowing the blowing resistance of the mold sand to be reduced. Consequently, the power consumption of the compressed air source can be suppressed, and occurrence of sand clogging can be suppressed.

A flaskless molding machine according to one embodiment may further include a storage unit configured to store the height position of the first lower sand tank detected by the first detector at completion of a last squeeze and the height position of the second lower sand tank detected by the second detector at the completion of the last squeeze, as a last molding result, wherein the control unit determines the height position of the first lower sand tank and the height position of the second lower sand tank at a next sand filling time, based on the last molding result stored in the storage unit. In such a configuration, the height position of the second lower sand tank is determined on the basis of the last molding result. Consequently, the height positions of the first communication port and the second communication port can be more accurately aligned with each other.

A flaskless molding machine according to one embodiment may further include: a third detector configured to detect a height position of the upper flask; and a fifth detector configured to detect a height position of the lower filling frame, wherein the upper plate has a fixed height position, and the control unit recognizes a thickness of the upper mold at the completion of squeeze based on the height position of the upper flask detected by the third detector at the completion of squeeze, and recognizes a thickness of the lower mold at the completion of squeeze based on the height position of the lower plate and the height position of the lower filling frame detected by the second detector and the fifth detector at the completion of squeeze, and determines the height position of the upper flask, the height position of the lower plate, the height position of the lower filling frame, the height position of the first lower sand tank, and the height position of the second lower sand tank at the next sand filling time, based on the recognized thicknesses of the upper mold and the lower mold. In such a configuration, the height position of the second lower sand tank is determined on the basis of the last molding result. Consequently, the height positions of the first communication port and the second communication port can be more accurately aligned with each other.

In one embodiment, the third detector may include: a magnet attached to the upper flask or a member moving together with the upper flask; and a detection portion attached to a fixed frame, consisting of a longitudinal member extending in the vertical direction, and configured to detect a magnetic field caused with the magnet. In such a configuration, the position of the upper flask can be contactlessly recognized.

In one embodiment, the fifth detector may include: a magnet attached to the lower filling frame or a member moving together with the lower filling frame; and a detection portion attached to a fixed frame, consisting of a longitudinal member extending in the vertical direction, and configured to detect a magnetic field caused with the magnet. In such a configuration, the position of the lower filling frame can be contactlessly recognized.

In one embodiment, the first detector may include: a magnet attached to the first lower sand tank or a member moving together with the first lower sand tank; and a detection portion attached to a fixed frame, consisting of a longitudinal member extending in the vertical direction, and configured to detect a magnetic field caused with the magnet. In such a configuration, the position of the first lower sand tank can be contactlessly recognized.

In one embodiment, the second detector may include: a magnet attached to the second lower sand tank or a member moving together with the second lower sand tank; and a detection portion attached to a fixed frame, consisting of a longitudinal member extending in the vertical direction, and configured to detect a magnetic field caused with the magnet. In such a configuration, the position of the second lower sand tank can be contactlessly recognized.

Advantageous Effects of Invention

According to the various aspects and embodiments of the present invention, a flaskless molding machine that forms excellent molds and casting products is provided.

DESCRIPTION OF EMBODIMENTS

Hereinafter, embodiments are described with reference to the drawings. The identical or corresponding portions in the diagrams are assigned identical signs, and redundant description is omitted. Hereinafter, the horizontal directions are assumed as X-axis and Y-axis directions, and the vertical direction (upward and downward direction) is assumed as a Z-axis direction.

[Overview of Flaskless Molding Machine]

Figure 1:
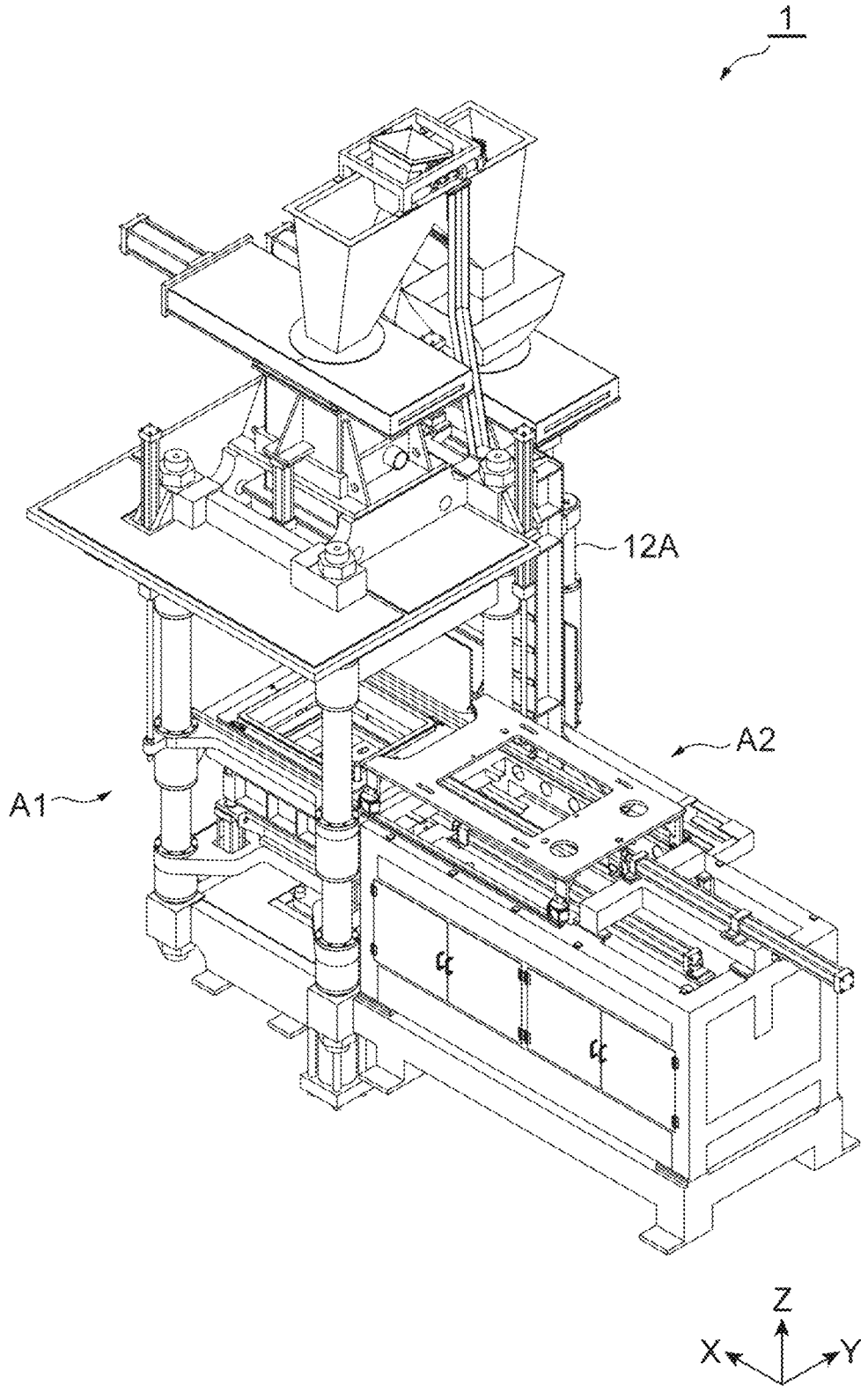
FIG. 1 is a perspective view on a front side of a flaskless molding machine according to one embodiment.

FIG. 1 is a perspective view on a front side of a flaskless molding machine 1 according to one embodiment. The flaskless molding machine 1 is a molding machine that forms a flaskless upper mold and lower mold. As shown in FIG. 1, the flaskless molding machine 1 includes a molding unit A1, and a conveyance unit A2. In the molding unit A1, an upper flask and a lower flask that have box shapes and are movable in the vertical direction (Z-axis direction) are disposed. The conveyance unit A2 introduces a match plate where models are arranged, to the molding unit A1. The upper flask and the lower flask of the molding unit A1 are moved to be close to each other, and clamp the match plate. The inside of the upper flask and the inside of the lower flask are filled with mold sand. The mold sand filled in the upper flask and the lower flask are pressurized in the vertical direction by a squeeze mechanism included in the molding unit A1, and the upper mold and the lower mold are simultaneously formed. Subsequently, an upper mold and a lower mold are stripped from the upper flask and the lower flask, respectively, and are conveyed to the outside of the machine. As described above, the flaskless molding machine 1 forms the flaskless upper mold and lower mold.

[Frame Structure]

Figure 2:
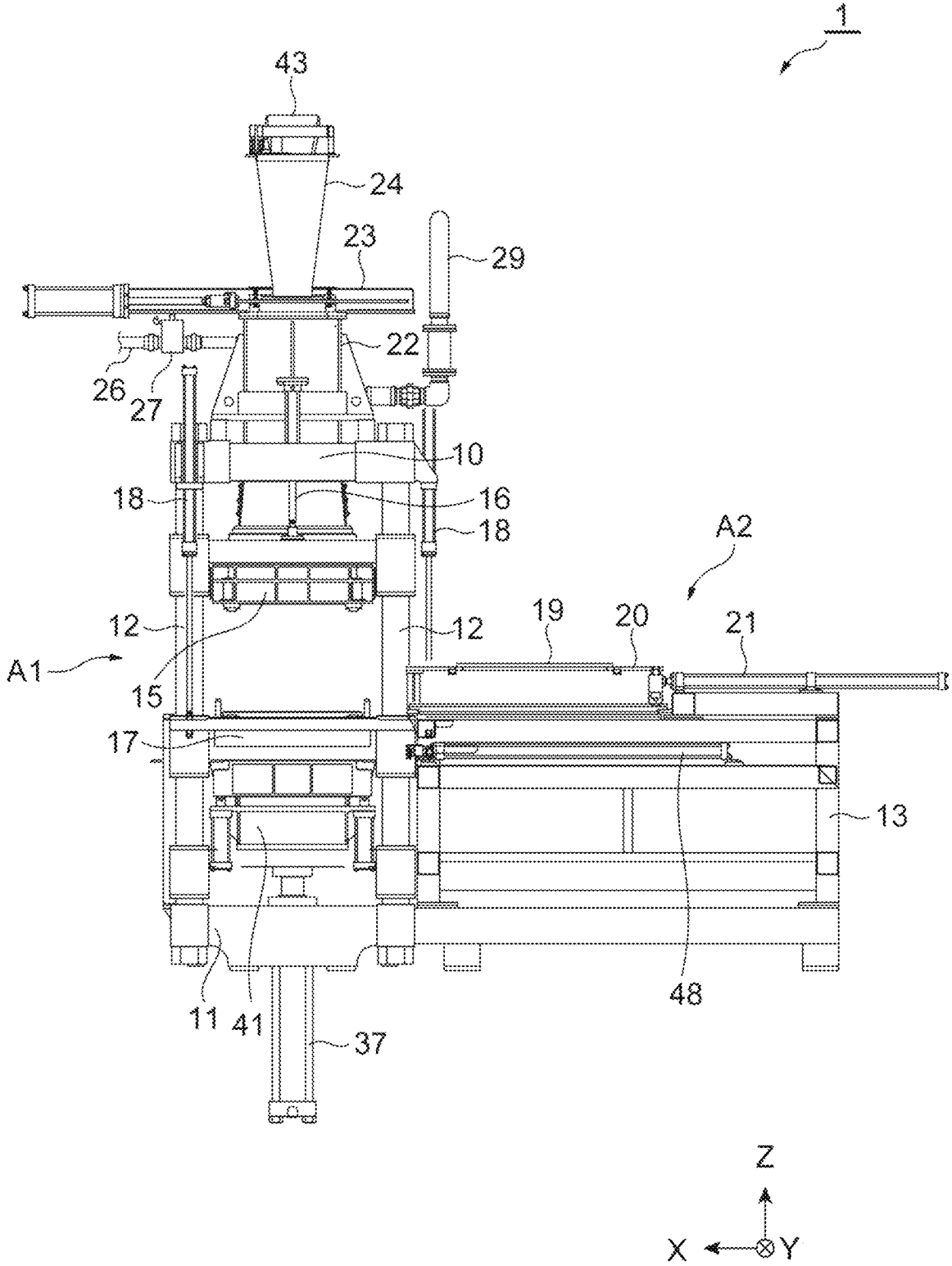
FIG. 2 is a front view of the flaskless molding machine according to one embodiment.
Figure 3:
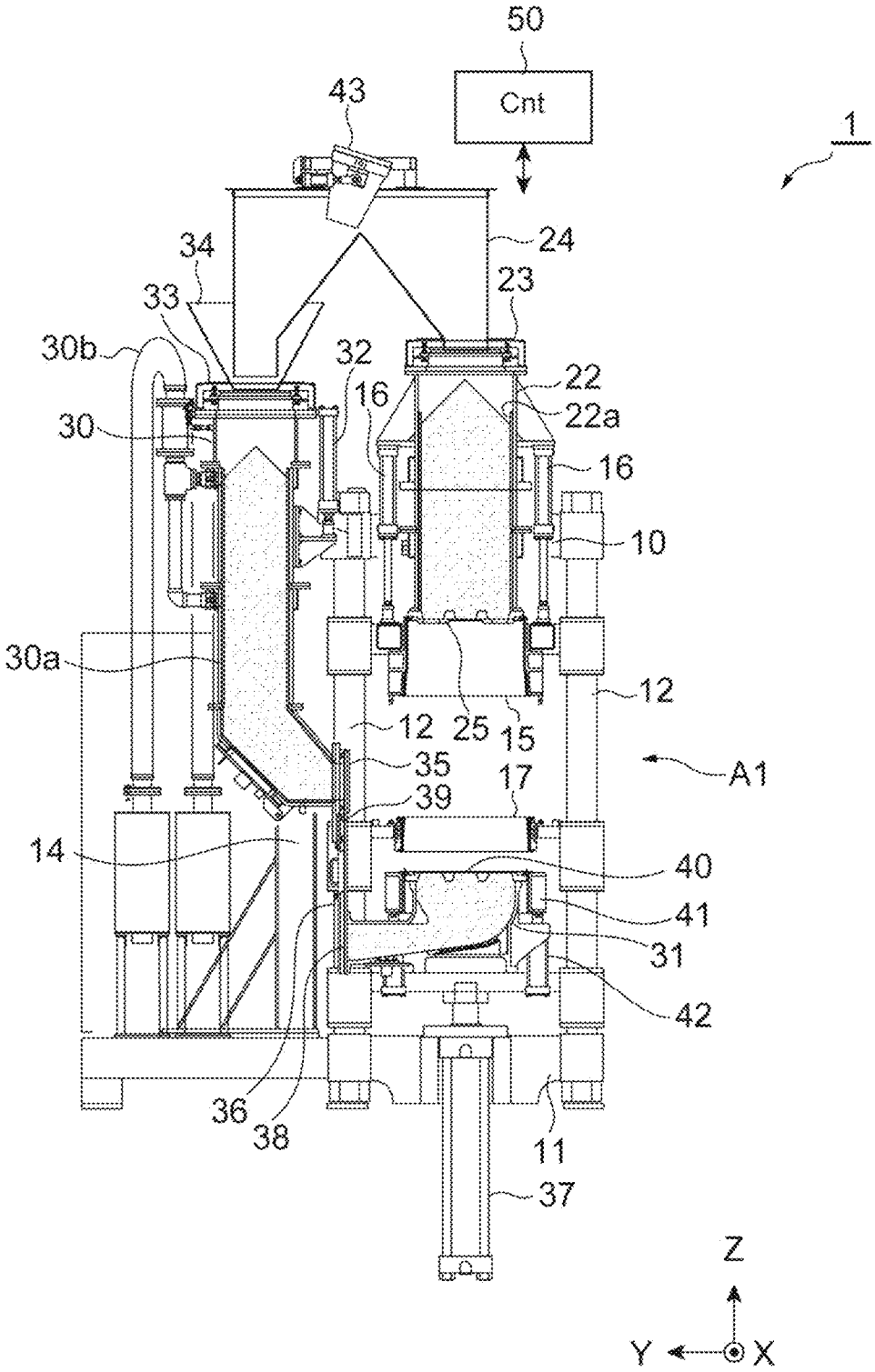
FIG. 3 is a schematic diagram on the left side of the flaskless molding machine according to one embodiment.

FIG. 2 is a front view of the flaskless molding machine 1 according to one embodiment. FIG. 3 is a schematic diagram on the left side of the flaskless molding machine 1 according to one embodiment. As shown in FIGS. 2 and 3, the flaskless molding machine 1 includes an upper frame 10, a lower frame 11, and four guides 12 that connect the upper frame 10 and the lower frame 11. As for the guides 12, their upper ends are connected to the upper frame 10, and their lower ends are connected to the lower frame 11. The frame of the molding unit A1 described above is made up of the upper frame 10, the lower frame 11 and the four guides 12.

On a side of the frame of the molding unit A1 (in the negative direction on the X-axis), a support frame 13 (FIG. 2) of the conveyance unit A2 is disposed. Furthermore, on a side of the frame of the molding unit A1 (the positive direction on the Y-axis), a support frame 14 (FIG. 3) extending in the vertical direction is disposed. The support frame 14 supports a first lower sand tank described later.

[Upper Flask and Lower Flask]

The flaskless molding machine 1 includes an upper flask 15. The upper flask 15 is a box-shaped frame where the upper end and the lower end are open. The upper flask 15 is movably attached to the four guides 12. The upper flask 15 is supported by an upper flask cylinder 16 attached to the upper frame 10, and vertically moves along the guides 12 according to the operation of the upper flask cylinder 16.

The flaskless molding machine 1 includes a lower flask 17 disposed below the upper flask 15. The lower flask 17 is a box-shaped frame where the upper end and the lower end are open. The lower flask 17 is movably attached to the four guides 12. The lower flask 17 is supported by two lower flask cylinders 18 (FIG. 2) attached to the upper frame 10, and vertically moves along the guides 12 according to the operation of the lower flask cylinders 18. Hereinafter, a region encircled by the guides 12 is also called a formation position.

A match plate 19 (FIG. 2) is introduced between the upper flask 15 and the lower flask 17, from the conveyance unit A2. The match plate 19 is a plate-shaped member with models being disposed on both the surfaces thereof, and moves to and from between the upper flask 15 and the lower flask 17. According to a specific example, the support frame 13 of the conveyance unit A2 includes rails toward a formation position, a conveyance plate 20 having rollers disposed on the rails, and a conveyance cylinder 21 that operates the conveyance plate 20. The match plate 19 is disposed on the conveyance plate 20, and is disposed at the formation position between the upper flask 15 and the lower flask 17 by the operation of the conveyance cylinder 21. The upper flask 15 and the lower flask 17 can clamp the disposed match plate 19, in the vertical direction. Hereinafter, a region on the support frame 13 is also called a retracted position.

[Sand Tank]

The flaskless molding machine 1 includes an upper sand tank 22 disposed above the upper flask 15. The upper sand tank 22 is attached to the upper frame 10. More specifically, the upper sand tank 22 is statically fixed to the upper frame 10. The upper sand tank 22 internally stores mold sand to be supplied to the upper flask 15. The upper sand tank 22 is open at its upper end and lower end. The upper end of the upper sand tank 22 is provided with a slide gate 23 that slides a plate-shaped shield member in the horizontal direction (the positive and negative directions on the X-axis). The upper sand tank 22 is configured so that its upper end can be opened and closed by the operation of the slide gate 23. A mold sand loading chute 24 that loads mold sand is fixedly disposed above the upper sand tank 22. The mold sand loading chute 24 is described later. When the slide gate 23 is in an open state, the mold sand is supplied through the mold sand loading chute 24 to the upper sand tank 22.

The lower end of the upper sand tank 22 is open, and an upper plate 25 (FIG. 3) is attached to the opening at the lower end. The upper plate 25 is a plate-shaped member, and has at least one supply port through which the upper sand tank 22 and the inside of the upper flask 15 communicate with each other. The mold sand in the upper sand tank 22 is supplied through the supply port of the upper plate 25 into the upper flask 15. The upper plate 25 has a size substantially identical to the size of the opening of the upper flask 15. The upper flask 15 moves in the upward direction, thereby causing the upper plate 25 to enter the inside of the upper flask 15. The upper flask 15 moves in the downward direction, thereby retracting the upper plate 25 from the upper flask 15. As described above, the upper plate 25 is configured to be capable of entering and being retracted from the inside of the upper flask 15. The details of the upper plate 25 are described later.

The upper sand tank 22 communicates with a compressed air source (not shown). According to a specific example, the upper sand tank 22 communicates, at its upper portion, with a pipe 26 (FIG. 2) for supplying compressed air, and communicates with the compressed air source through the pipe 26. The pipe 26 is provided with an electro-pneumatic proportional valve 27 (FIG. 2). The electro-pneumatic proportional valve 27 not only switches supply and stop of compressed air but also automatically adjusts the valve opening degree according to the pressure on the output side. Accordingly, the compressed air at a predetermined pressure is supplied to the upper sand tank 22. When the slide gate 23 is in a closed state, the compressed air supplied from the upper portion of the upper sand tank 22 is blown toward the lower portion of the upper sand tank 22. The mold sand in the upper sand tank 22 is supplied, together with the compressed air, through the supply port of the upper plate 25 into the upper flask 15.

The upper sand tank 22 is provided, on its inner surface, with a permeation member 22*a* (FIG. 3) having a plurality of pores that allow the compressed air to pass. Accordingly, the compressed air is supplied through the entire surface of the permeation member 22*a* to the entire inner space, thereby improving the fluidity of the mold sand. The permeation member 22*a* may be formed of a porous material. The upper sand tank 22 communicates, at its side portion, with a pipe (not shown) for supplying compressed air, and a pipe 29 (FIG. 2) for discharging the compressed air. The pipe 29 is provided with a filter that does not allow the mold sand to pass but allows the compressed air to pass, and can prevent the mold sand from being discharged to the outside of the upper sand tank 22.

The flaskless molding machine 1 includes a lower sand tank that stores mold sand to be supplied into the lower flask 17. According to an example, the lower sand tank is divided into a first lower sand tank 30 (FIG. 3) and a second lower sand tank 31 (FIG. 3). The first lower sand tank 30 is disposed on a side of the upper sand tank 22. The first lower sand tank 30 internally stores mold sand to be supplied to the lower flask 17.

The first lower sand tank 30 is supported by the support frame 14, and is movably attached to a vertically extending guide 12A (FIG. 1) provided for the support frame 14. More specifically, the first lower sand tank 30 is supported by a lower tank cylinder (adjustment drive unit) 32 (FIG. 3) attached to the upper frame 10, and vertically moves along the guide 12A according to the operation of the lower tank cylinder 32.

The first lower sand tank 30 is open at its upper end. The upper end of the first lower sand tank 30 is provided with a slide gate 33 (FIG. 3) that slides a plate-shaped shield member in the horizontal direction (the positive and negative directions on the X-axis). The first lower sand tank 30 is configured so that its upper end can be opened and closed by the operation of the slide gate 33. A hopper 34 (FIG. 3) for loading mold sand is fixedly disposed above the first lower sand tank 30. The communication relationship between the hopper 34 and the mold sand loading chute 24 is described later. When the slide gate 33 is in an open state, the mold sand is supplied through the hopper 34 to the first lower sand tank 30.

The first lower sand tank 30 is bent at its lower end in the horizontal direction (the negative direction on the Y-axis), and, at its distal end, a first communication port 35 (FIG. 3) for discharging the stored mold sand is formed. The first communication port 35 is configured so that this port can communicate with an after-mentioned second communication port of the second lower sand tank 31 at a predetermined height (communication position). The mold sand is supplied through the first communication port 35 to the second lower sand tank 31. The distal end of the first lower sand tank 30 is provided with a first block plate 36 (FIG. 3) that extends in the vertical direction. When an after-mentioned second communication port of the second lower sand tank 31 is not at a communication position, this port is shielded by the first block plate 36.

The first lower sand tank 30 communicates with the compressed air source (not shown). According to a specific example, the first lower sand tank 30 communicates, at its upper portion, with a pipe (not shown) for supplying compressed air, and communicates with the compressed air source through the pipe. The pipe is provided with an electro-pneumatic proportional valve (not shown). Accordingly, the compressed air at a predetermined pressure is supplied to the first lower sand tank 30. When the slide gate 33 is in the closed state and the after-mentioned second communication port of the second lower sand tank 31 is at the communication position, the compressed air is supplied through the upper portion of the first lower sand tank 30. The compressed air is blown toward the lower portion of the first lower sand tank 30, and the mold sand in the first lower sand tank 30 is supplied together with the compressed air through the first communication port 35 into the second lower sand tank 31.

The first lower sand tank 30 is provided, on its inner surface, with a permeation member 30*a* (FIG. 3) having a plurality of pores that allow the compressed air to pass. Accordingly, the compressed air is supplied through the entire surface of the permeation member 30*a* to the entire inner space, thereby improving the fluidity of the mold sand. The permeation member 30*a* may be formed of a porous material. A side portion of the first lower sand tank 30 communicates with a pipe 30*b* (FIG. 3) for discharging the compressed air. The pipe 30*b* is provided with a filter that does not allow the mold sand to pass but allows the compressed air to pass, and can prevent the mold sand from being discharged to the outside of the first lower sand tank 30.

The second lower sand tank 31 is disposed below the lower flask 17. The second lower sand tank 31 internally stores mold sand to be supplied to the lower flask 17. The second lower sand tank 31 is movably attached to the four guides 12, and is supported in a vertically movable manner by a vertically extending squeeze cylinder (drive unit) 37.

At a side portion of the second lower sand tank 31, a second communication port 38 (FIG. 3) that can communicate with the first communication port 35 of the first lower sand tank is formed. The second communication port 38 is configured so that this port can communicate with the first communication port 35 of the first lower sand tank 30 at a predetermined height (communication position). The communication position has a height at which the first communication port 35 and the second communication port 38 communicate with each other and, more specifically, is a position at which the first communication port 35 and the second communication port 38 are disposed concentrically with each other. The first communication port 35 and the second communication port 38 communicate with each other on a communication plane along the vertical direction.

Figure 4:
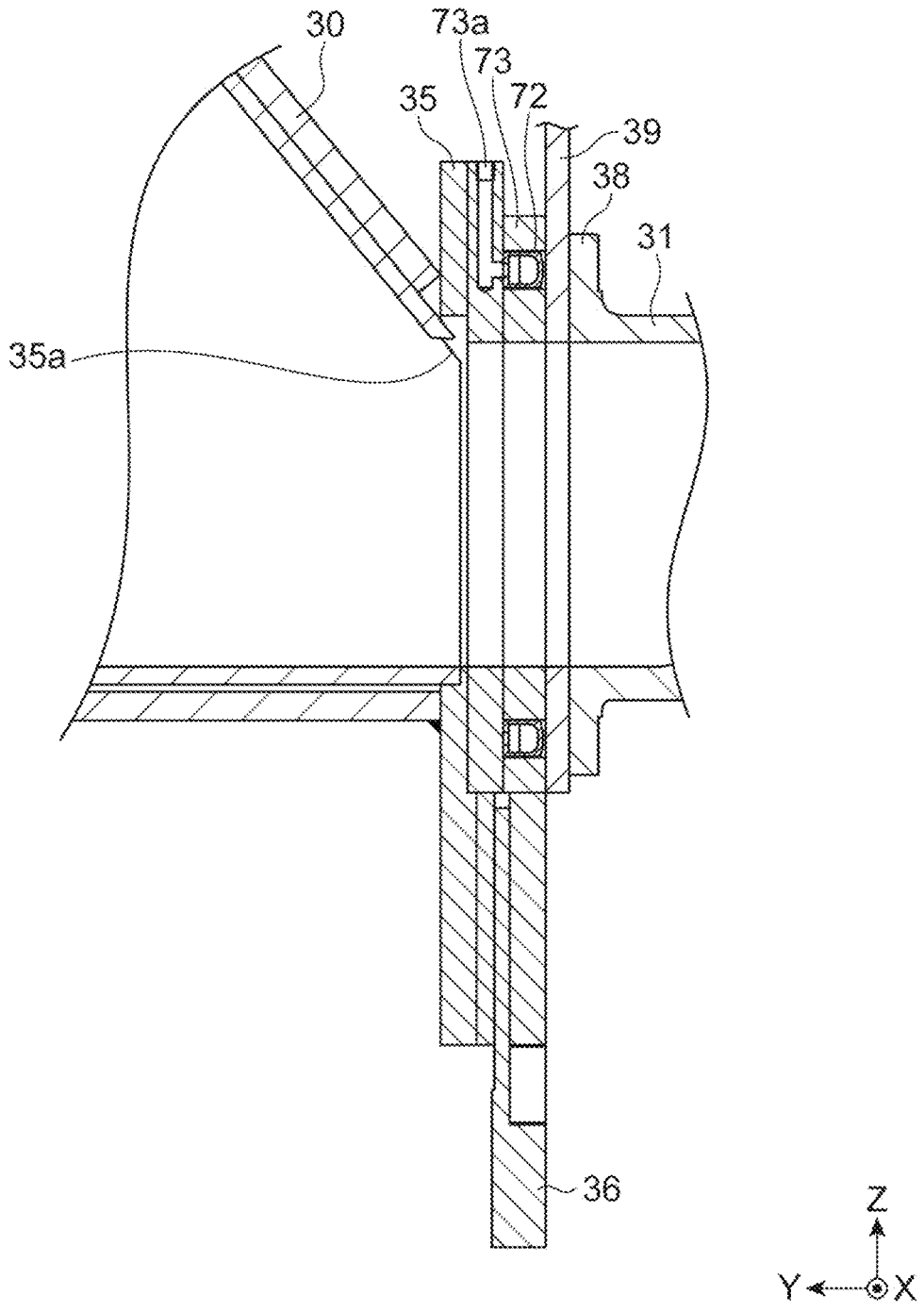
FIG. 4 is a partial sectional view in a state where a first lower sand tank and a second lower sand tank communicate with each other.
Figure 5:
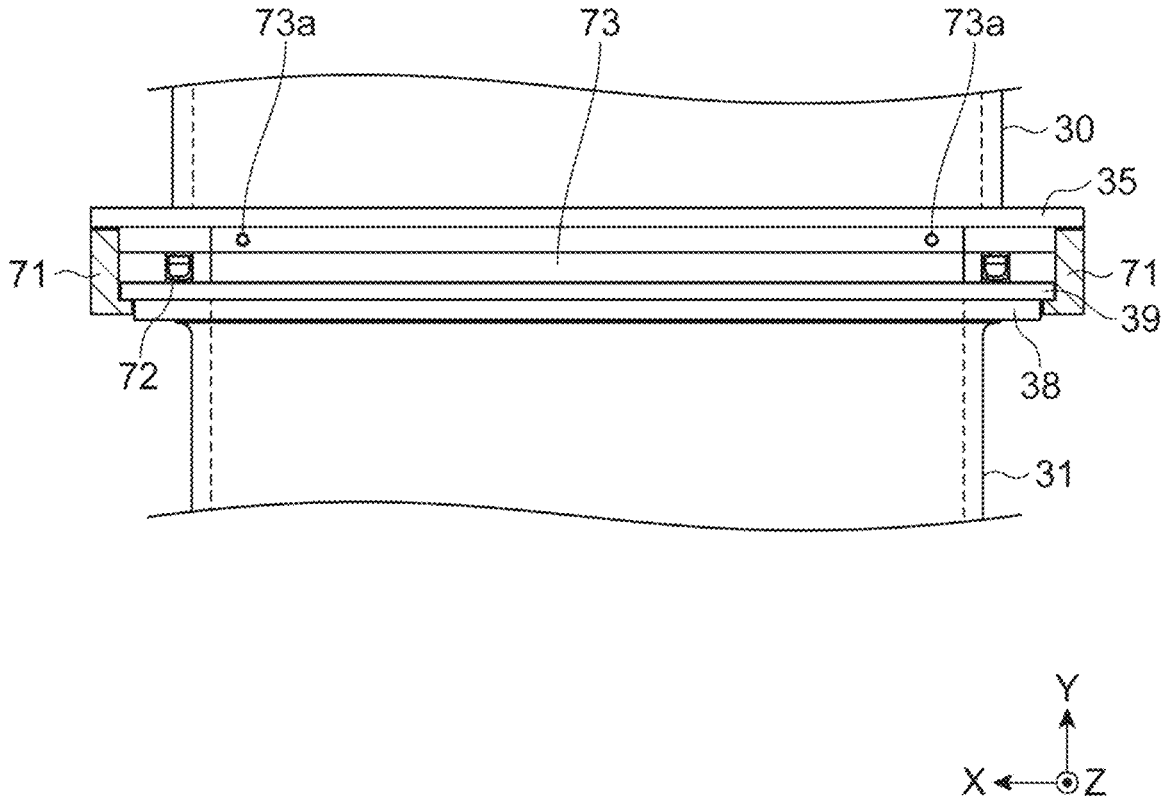
FIG. 5 is a plan view in the state where the first lower sand tank and the second lower sand tank communicate with each other.

FIG. 4 is a partial sectional view in the state where the first lower sand tank 30 and the second lower sand tank 31 communicate with each other. FIG. 5 is a plan view in the state where the first lower sand tank 30 and the second lower sand tank 31 communicate with each other. As shown in FIGS. 4 and 5, the first lower sand tank 30 and the second lower sand tank 31 are in a state of communicating with each other through communication between the first communication port 35 and the second communication port 38 being at the predetermined communication position. The mold sand is supplied through the first communication port 35 and the second communication port 38 from the first lower sand tank 30 to the second lower sand tank 31. The second communication port 38 of the second lower sand tank 31 is provided with a vertically extending second block plate 39 (FIGS. 3 to 5). The opposite sides of the first communication port 35 of the first lower sand tank 30 are provided with guide rails 71 (FIG. 5) that guide a second block plate 39. The second block plate 39 is guided by the guide rails 71, thereby allowing the first communication port 35 and the second communication port 38 to be guided to the communication position without being inclined from each other. When the first communication port 35 of the first lower sand tank 30 is not at the communication position, this port is shielded by the second block plate 39.

Figure 6:
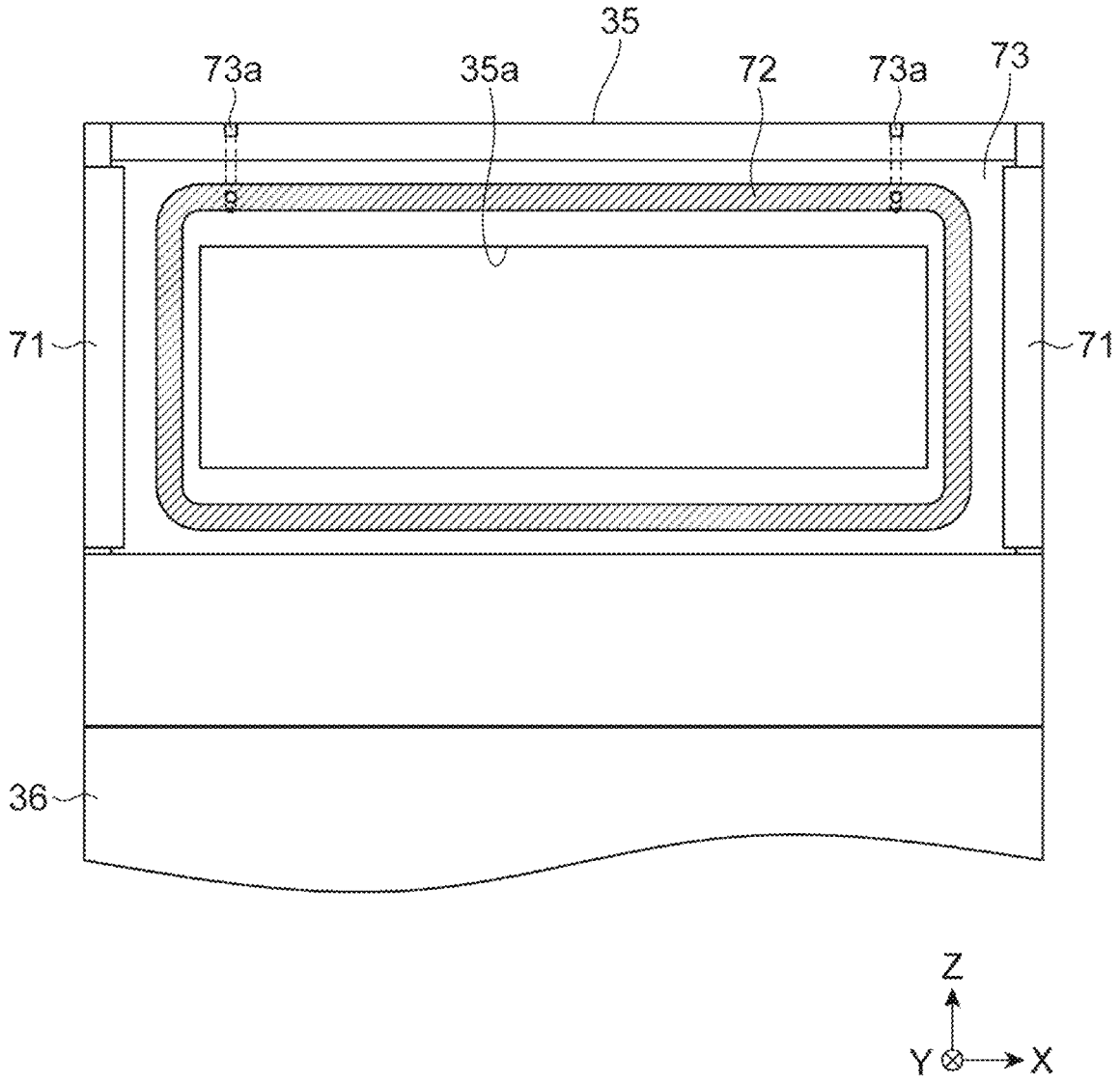
FIG. 6 is a schematic diagram of a first communication port of the first lower sand tank.
Figure 7:
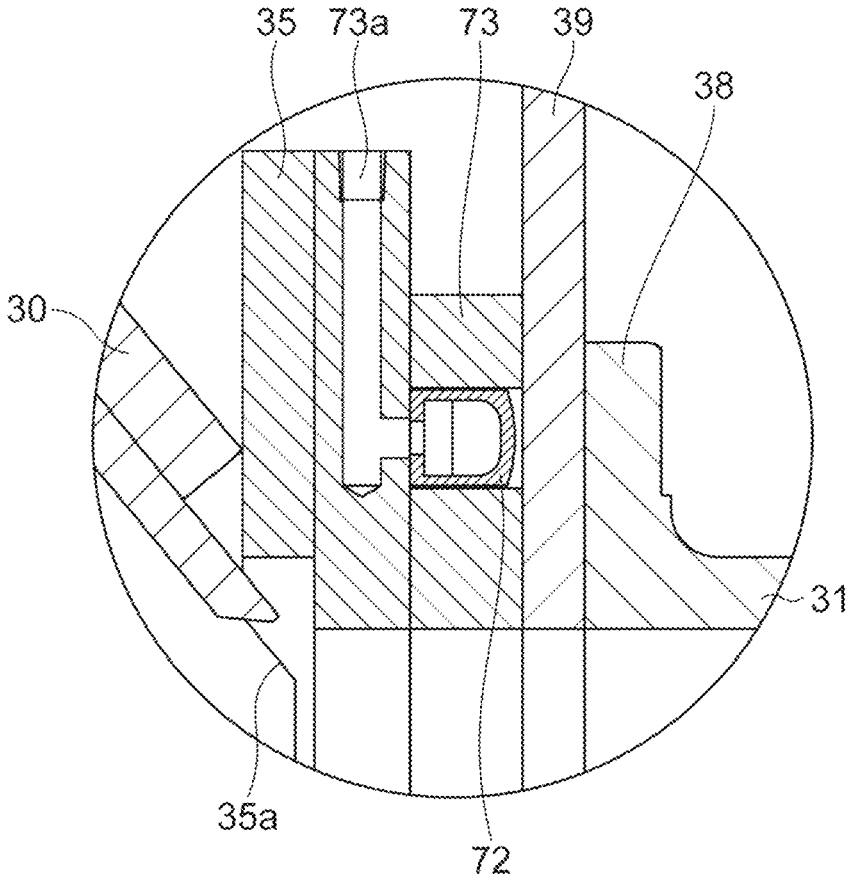
FIG. 7 is a partially enlarged sectional view of a sealing mechanism.

It should be noted that the flaskless molding machine 1 may include a sealing mechanism that hermetically seals the communication planes of the first communication port 35 and the second communication port 38. For example, the sealing mechanism is provided on the first communication port 35 side. FIG. 6 is a schematic diagram of the first communication port 35 of the first lower sand tank 30, and is a diagram showing the first communication port 35 from the open side. As shown in FIG. 6, the first communication port 35 has an opening 35*a* that communicates with the inside of the first lower sand tank 30. The sealing mechanism includes a sealing member 72 and a holding member 73. The sealing member 72 is an annular member that encircles the opening 35*a*. The sealing member 72 has a tubular shape that can guide gas into its inside, and has a flexibility. The holding member 73 is an annular member that encircles the opening 35*a*, and is in contact with the second block plate 39. A groove that can accommodate the sealing member 72 is formed on a surface of the holding member 73 with which the second block plate 39 is in contact. FIG. 7 is a partially enlarged sectional view of the sealing mechanism. As shown in FIG. 7, the sealing member 72 is accommodated to an extent not extruding from the surface of the holding member 73 with which the second block plate 39 is in contact. At the holding member 73, a gas guide port 73*a* (FIGS. 4 to 7) that communicates with the sealing member 72 is formed. The sealing member 72 is inflated when gas is introduced into its inside, and extrudes from the surface of the holding member 73 to enclose hermetically the communication planes of the first communication port 35 and the second communication port 38. It should be noted that the flaskless molding machine 1 may adopt a sealing mechanism other than the sealing mechanism shown in FIGS. 4 to 7.

The upper end of the second lower sand tank 31 is open, and a lower plate 40 (FIG. 3) is attached to the opening at the upper end. The lower plate 40 is a plate-shaped member, and has at least one supply port through which the second lower sand tank 31 and the inside of the lower flask 17 communicate with each other. The mold sand in the second lower sand tank 31 is supplied through the supply port of the lower plate 40 and an after-mentioned lower filling frame into the lower flask 17. The details of the lower plate 40 are described later.

[Lower Filling Frame]

The flaskless molding machine 1 includes, for example, a lower filling frame 41 (FIG. 2, FIG. 3). The lower filling frame 41 is disposed below the lower flask 17. The lower filling frame 41 is a box-shaped frame where the upper end and the lower end are open. The opening at the upper end of the lower filling frame 41 communicates with the opening at the lower end of the lower flask 17. The lower filling frame 41 is configured so that its inside can accommodate the second lower sand tank 31. The lower filling frame 41 is supported in a vertically movable manner by a lower filling frame cylinder 42 (FIG. 3) fixed to the second lower sand tank 31. The lower plate 40 has a size substantially identical to each of the sizes of openings of the lower filling frame 41 and the lower flask 17. A position where the vertically movable lower filling frame 41 internally accommodates the second lower sand tank 31 and the lower plate 40 is an original position (initial position), and serves as a descending end. The lower filling frame 41 moves in the upward direction, thereby retracting the lower plate 40 from the lower filling frame 41. The lower filling frame 41 having moved in the upward direction is moved in the downward direction, thereby allowing the lower plate 40 to enter the inside of the lower filling frame 41. As described above, the lower plate 40 is configured to be capable of entering and being retracted from the inside of the lower filling frame 41 (movable to and from). The flaskless molding machine 1 can reduce the stroke of the lower flask 17 by including the lower filling frame 41. Consequently, the flaskless molding machine having a lower machine height can be achieved in comparison with a case of not including the lower filling frame 41. Furthermore, as the flaskless molding machine 1 can reduce the stroke of the lower flask 17 by including the lower filling frame 41, the molding time of the pair of the upper mold and the lower mold can be reduced.

It should be noted that the flaskless molding machine 1 does not necessarily include the lower filling frame 41. In this case, the lower plate 40 is configured to be capable of entering and being retracted from the inside of the lower flask 17 (movable to and from). The descending end of the vertically movable lower flask 17 is the original position (initial position). That is, the lower plate 40 enters the inside of the lower flask 17 by moving in the upward direction relatively more than the lower flask 17 moving in the upward direction. The lower plate 40 is retracted from the lower flask 17 by moving in the downward direction relatively more than the lower flask 17.

[Molding Space and Squeeze]

The molding space (upper molding space) of the upper mold is formed by the upper plate 25, the upper flask 15 and the match plate 19. The molding space (lower molding space) of the lower mold is formed by the lower plate 40, the lower flask 17 and the match plate 19. The upper molding space and the lower molding space are formed when the upper flask cylinder 16, the lower flask cylinders 18 and the squeeze cylinder 37 are operated and the upper flask 15 and the lower flask 17 clamp the match plate at a predetermined height. In a case where the flaskless molding machine 1 includes the lower filling frame 41, the lower molding space may be formed by the lower plate 40, the lower flask 17, the lower filling frame 41 and the match plate 19.

The upper molding space is filled with the mold sand stored in the upper sand tank 22, through the upper plate 25. The lower molding space is filled with the mold sand stored in the second lower sand tank 31, through the lower plate 40. The CB of the mold sand with which the upper molding space and the lower molding space are filled may be set in a range from 30% to 42%. The compressive strength of the mold sand with which the upper molding space and the lower molding space are filled may be set in a range from 8 to 15 $N/cm^2$. It should be noted that as the thickness of the mold to be formed is changed according to the model shape and the CB (compactability) of the mold sand, the height of a target of the second lower sand tank 31 is changed according to the thickness of the mold. That is, the height of the second communication port 38 of the second lower sand tank 31 is changed. At this time, the height of the first communication port 35 of the first lower sand tank 30 is adjusted to be at the communication position of the second communication port 38 of the second lower sand tank 31 by the lower tank cylinder 32. Such adjustment can be achieved by an after-mentioned control device 50 (FIG. 3).

In a state where the upper molding space and the lower molding space are filled with the mold sand, the squeeze cylinder 37 performs squeezing with the upper plate 25 and the lower plate 40 by moving the second lower sand tank 31 upward. Accordingly, a pressure is applied to the mold sand in the upper molding space, and the upper mold is formed. At the same time, a pressure is applied to the mold sand in the lower molding space, and the lower mold is formed.

[Mold Sand Loading Chute]

The mold sand loading chute 24 is open at the upper end, and is bifurcated at the lower end. The upper end is provided with a switch damper 43. The switch damper 43 changes its inclination direction so that the mold sand can fall to any one of the bifurcated lower end portions. One lower end portion of the mold sand loading chute 24 is fixed to the upper portion of the upper sand tank 22, and the other lower end portion of the mold sand loading chute 24 is accommodated in the hopper 34 and is not fixed. Since the lower end portion on the first lower sand tank 30 side is not fixed as described above, the lower tank cylinder 32 can control the height of the first communication port 35 of the first lower sand tank 30 independently from the upper sand tank 22.

[Details of Lower Plate]

Figure 8:
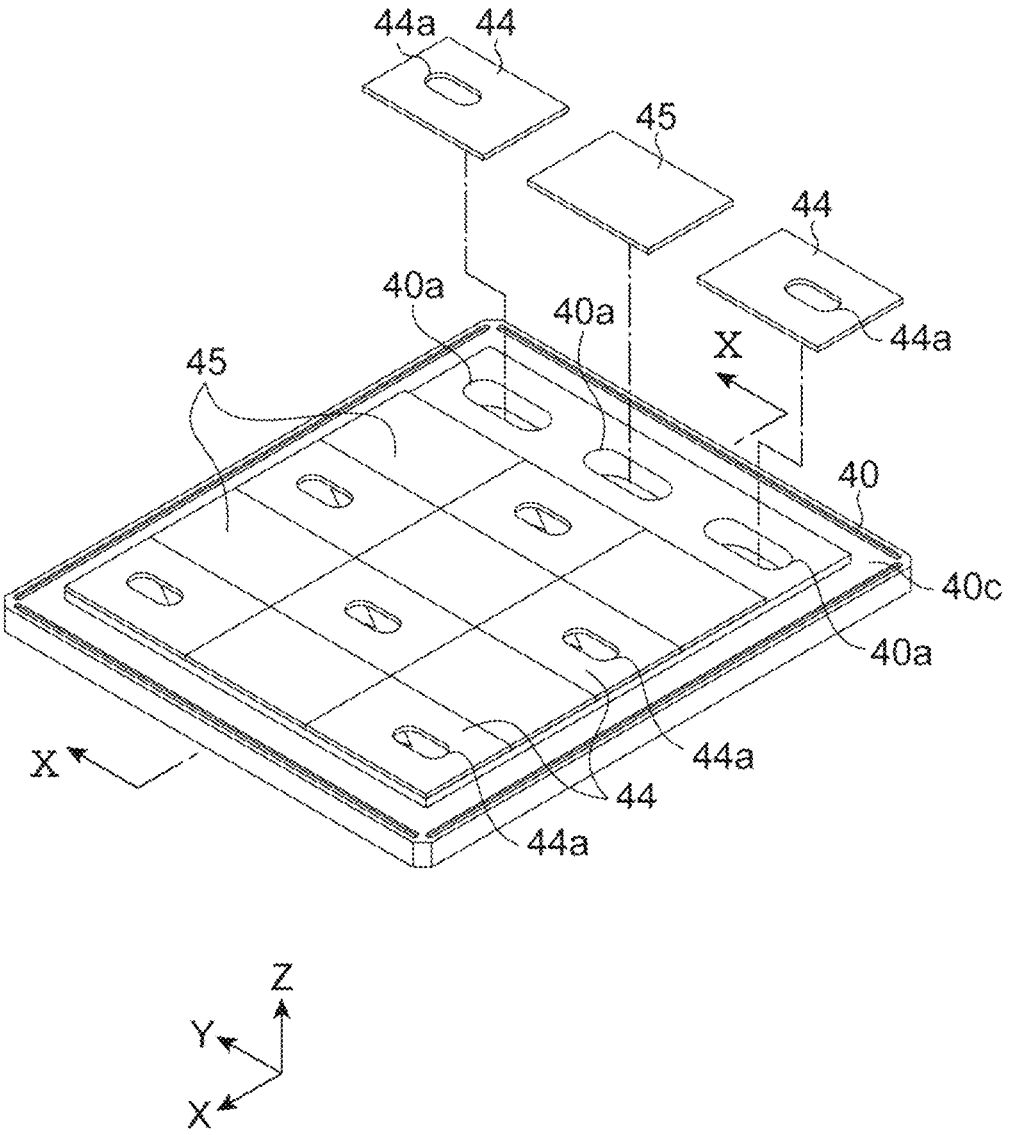
FIG. 8 is a perspective view on an upper surface side of a lower plate.
Figure 9:
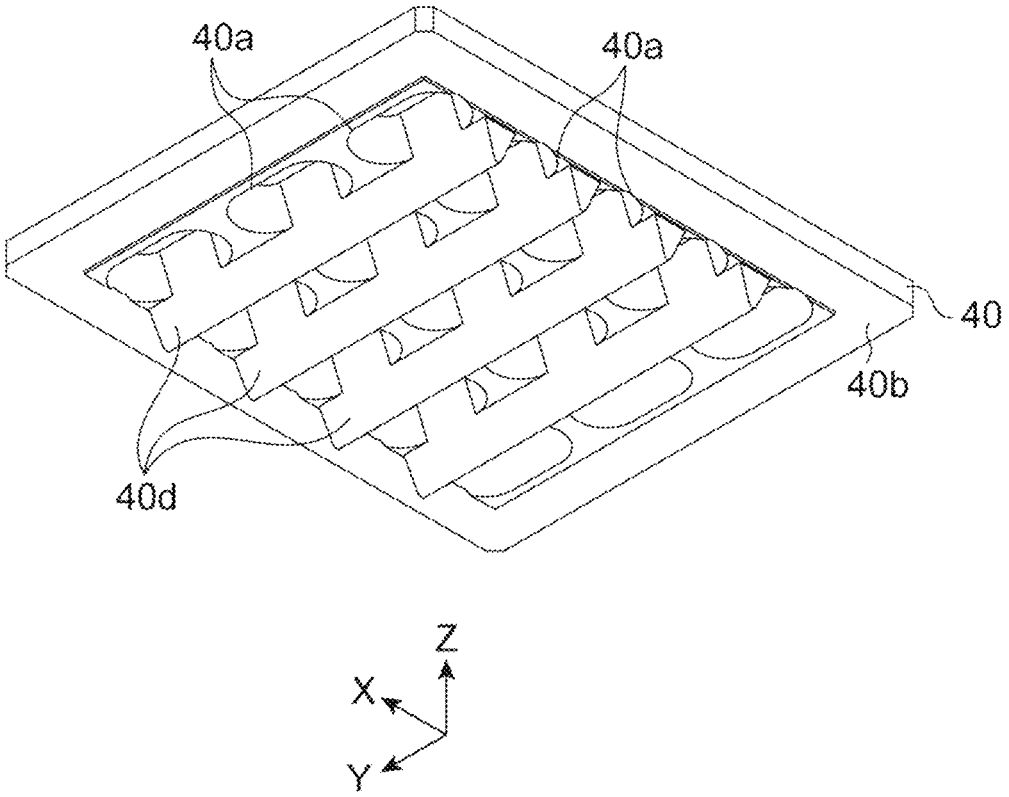
FIG. 9 is a perspective view on a lower surface side of the lower plate.
Figure 10:
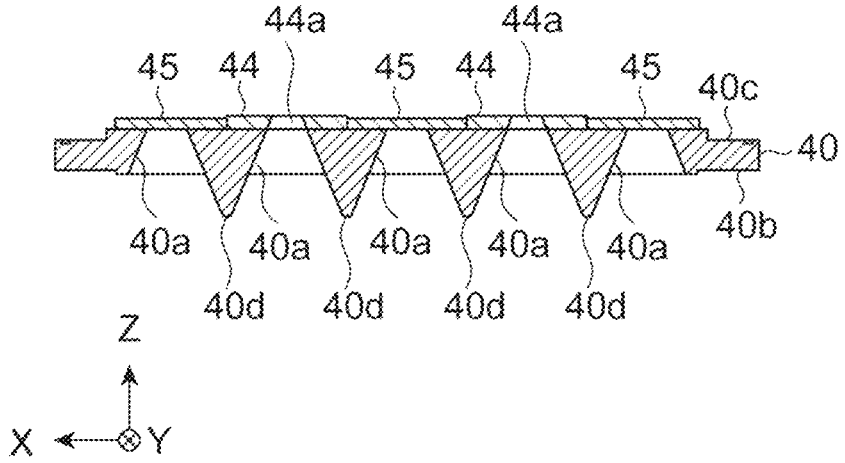
FIG. 10 is a sectional view taken along line X-X of FIG. 8.

FIG. 8 is a perspective view on an upper surface side of the lower plate 40. FIG. 9 is a perspective view on a lower surface side of the lower plate 40. FIG. 10 is a sectional view taken along line X-X of FIG. 8. As shown in FIGS. 8 to 10, the lower plate 40 has at least one supply port 40*a*. In the diagram, for example, 15 supply ports 40*a* are formed. The inner surface of each supply port 40*a* is inclined so that the opening on the upper surface 40*c* of the lower plate 40 can be narrower than the opening on the lower surface 40*b* of the lower plate 40. Such a shape (inverted taper shape) can prevent the mold sand from being strongly compressed at the supply port 40*a* during squeezing. That is, such a shape can prevent the supply ports 40*a* from being clogged with the sand at the next sand supply.

The lower surface 40*b* of the lower plate 40 is provided with protrusions 40*d* that have inclined surfaces which are inclined toward one or more supply ports 40*a*. The protrusions 40*d* have a substantially triangular section on the XZ plane. The inclination of the inclined surface of the protrusion 40*d* is the same as the inclination of the inner surface of the supply port 40*a*. Accordingly, the mold sand can be smoothly supplied to the supply ports 40*a* by the protrusions 40*d*. Furthermore, by providing the protrusions 40*d*, the mold sand can be prevented from being stagnant at the supply ports 40*a*.

Nozzle plates (nozzles) 44 or block plates 45 may be arranged on the upper surface 40*c* of the lower plate 40. The nozzle plates 44 are plate-shaped members, and openings 44*a* communicating with the supply ports are formed. The inclination of the inner surface of the opening 44*a* may be the same as the inclination of the supply port 40*a* or may be a different inclination. The formation positions of the openings 44*a* may be appropriately defined. For example, the opening 44*a* is formed at a position displaced in the X-axis direction or the Y-axis direction from the center of the nozzle plate 44, and the supply port 40*a* and the opening 44*a* are not concentrically arranged, thereby allowing the injection direction to be shifted in the horizontal direction. Accordingly, for example, in a case where a model has a deep position, the nozzle plates 44 can be arranged so that the mold sand can be supplied to the deep position. Furthermore, the opening direction of the opening 44*a* (the direction of the axis of the opening) is inclined at an angle from the vertical direction, thereby allowing the injection direction to be controlled. Accordingly, even for a complicated model, filling with the mold sand can be securely achieved. The block plates 45 are plate-shaped members, and openings are not formed. The block plate 45 is used to block the supply port preliminarily selected from among the supply ports 40*a*. For example, in a case where the model has a shallow position, the arrangement is achieved to block the supply ports 40*a* corresponding to the shallow position. Accordingly, the nozzle plates 44 and the block plates 45 are appropriately selected in conformity with the model. For example, the nozzle plates 44 and the block plates 45 are formed to have the same thickness, and their upper surfaces reside on the identical plane. Accordingly, the completed upper and lower molds can be extruded to the outside of the machine.

[Details of Upper Plate]

Figure 11:
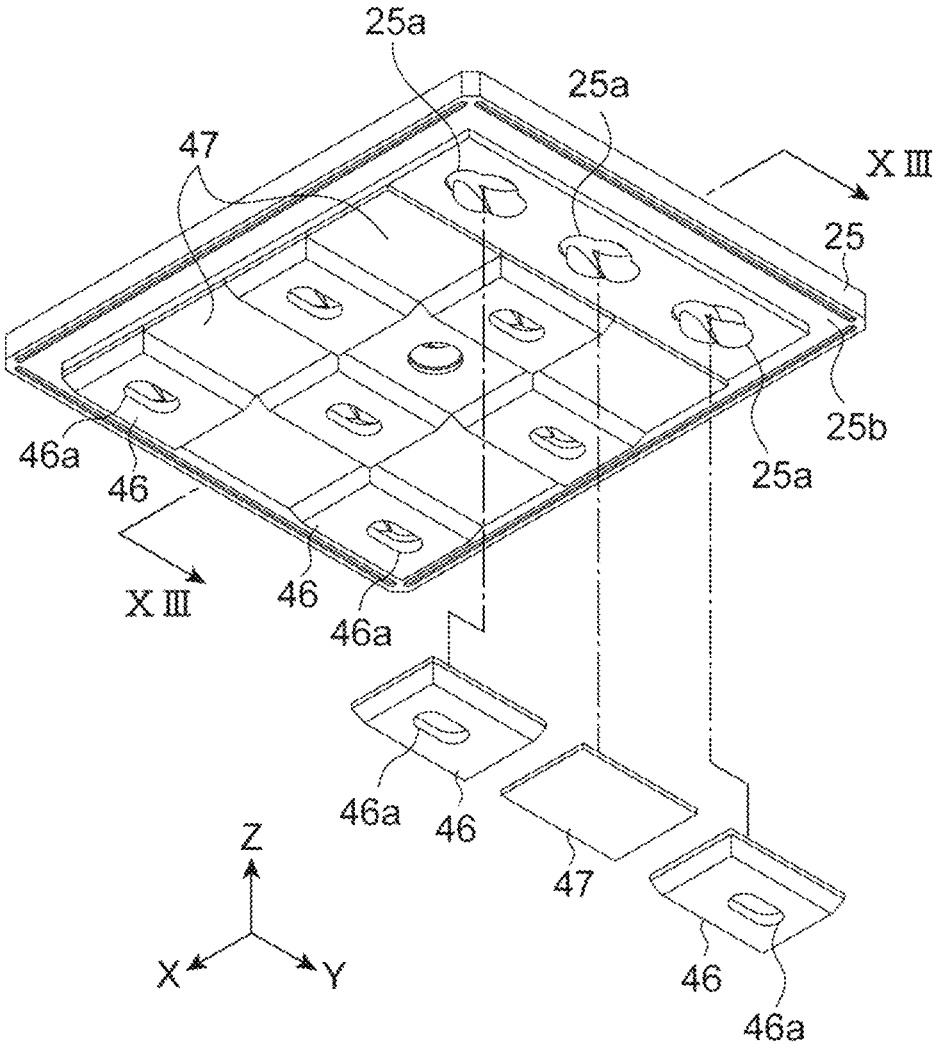
FIG. 11 is a perspective view on the lower surface side of an upper plate.
Figure 12:
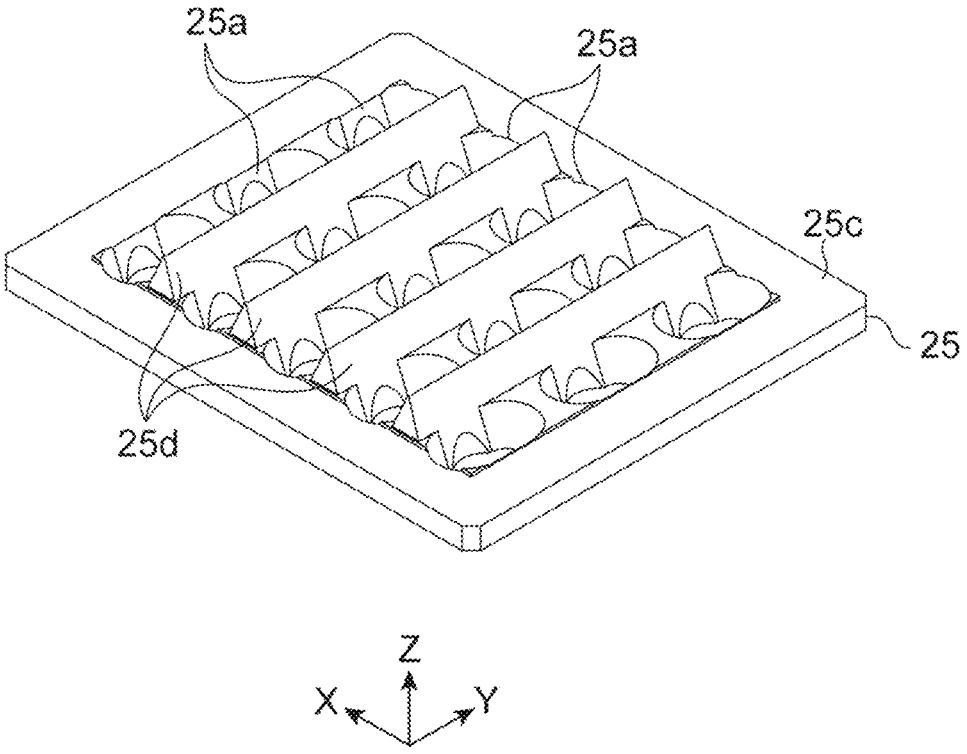
FIG. 12 is a perspective view on the upper surface side of the upper plate.
Figure 13:
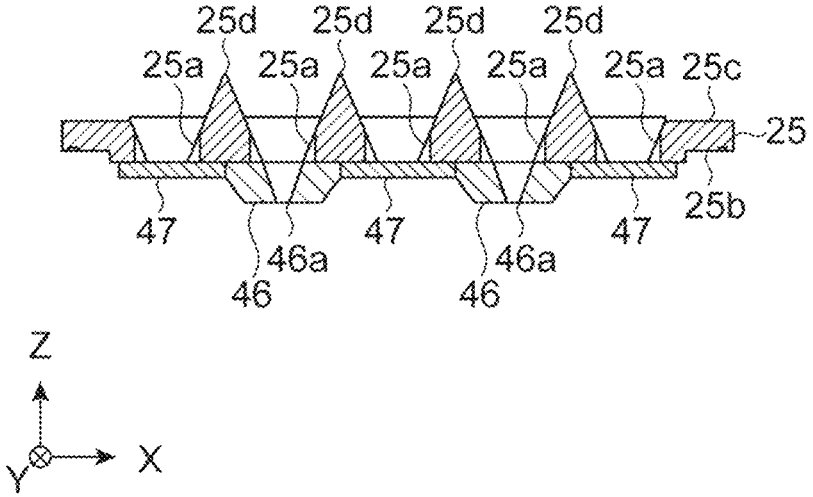
FIG. 13 is a sectional view taken along line XIII-XIII of FIG. 11.

FIG. 11 is a perspective view on the lower surface side of the upper plate 25. FIG. 12 is a perspective view on the upper surface side of the upper plate 25. FIG. 13 is a sectional view taken along line XIII-XIII of FIG. 11. As shown in FIGS. 11 to 13, the upper plate 25 has at least one supply port 25*a*. In the diagram, for example, 15 supply ports 25*a* are formed. The inner surface of each supply port 25*a* is inclined so that the opening on the lower surface 25*b* of the upper plate 25 can be narrower than the opening on the upper surface 25*c* of the upper plate 25. Such a shape (inverted taper shape) can prevent the mold sand from being strongly compressed at the supply port 25*a* during squeezing. That is, such a shape can solidify the mold sand in such a way not to fall by the gravity during squeezing, and prevent the supply ports 25*a* from being clogged with the sand at the next sand supply.

The upper surface 25*c* of the upper plate 25 is provided with protrusions 25*d* that have inclined surfaces which are inclined toward one or more supply ports 25*a*. The protrusions 25*d* have a substantially triangular section on the XZ plane. The inclination of the inclined surface of the protrusion 25*d* is the same as the inclination of the inner surface of the supply port 25*a*. Accordingly, the mold sand can be smoothly supplied to the supply ports 25*a* by the protrusions 25*d*. Furthermore, by providing the protrusions 25*d*, the mold sand can be prevented from being stagnant at the supply ports 25*a*.

Nozzle plates (nozzles) 46 or block plates 47 may be arranged on the lower surface 25*b* of the upper plate 25. The nozzle plates 46 are plate-shaped members, and openings 46*a* communicating with the supply ports are formed. The inclination of the inner surface of the opening 46*a* may be the same as the inclination of the supply port 25*a* or may be a different inclination. The formation positions of the openings 46*a* may be appropriately defined. For example, the opening 46*a* is formed at a position displaced in the X-axis direction or the Y-axis direction from the center of the nozzle plate 46, and the supply port 25*a* and the opening 46*a* are not concentrically arranged, thereby allowing the injection direction to be shifted in the horizontal direction. Accordingly, for example, in a case where a model has a deep position, the nozzle plates 46 can be arranged so that the mold sand can be supplied to the deep position. Furthermore, the direction of the opening 46*a* (the direction of the axis of the opening) is inclined at an angle from the vertical direction, thereby allowing the injection direction to be controlled. Accordingly, even for a complicated model, filling with the mold sand can be securely achieved. The block plates 47 are plate-shaped members, and openings are not formed. The block plate 47 is used to block the supply port preliminarily selected from among the supply ports 25*a*. For example, in a case where the model has a shallow position, the arrangement is achieved to block the supply ports 25*a* corresponding to the shallow position. Accordingly, the nozzle plates 46 and the block plates 47 are appropriately selected in conformity with the model.

[Bush]

Figure 14:
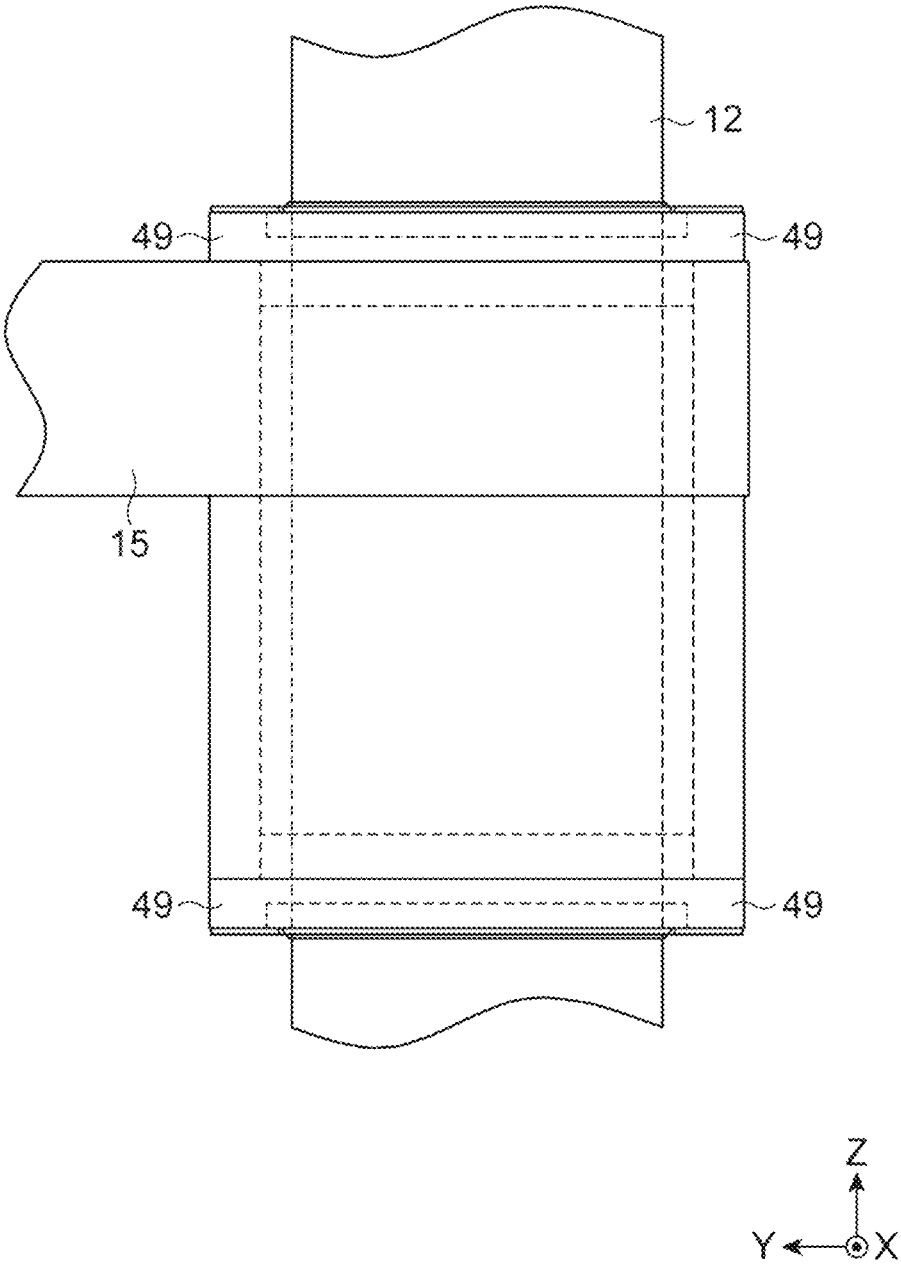
FIG. 14 is a schematic diagram illustrating a bush.
Figure 15:
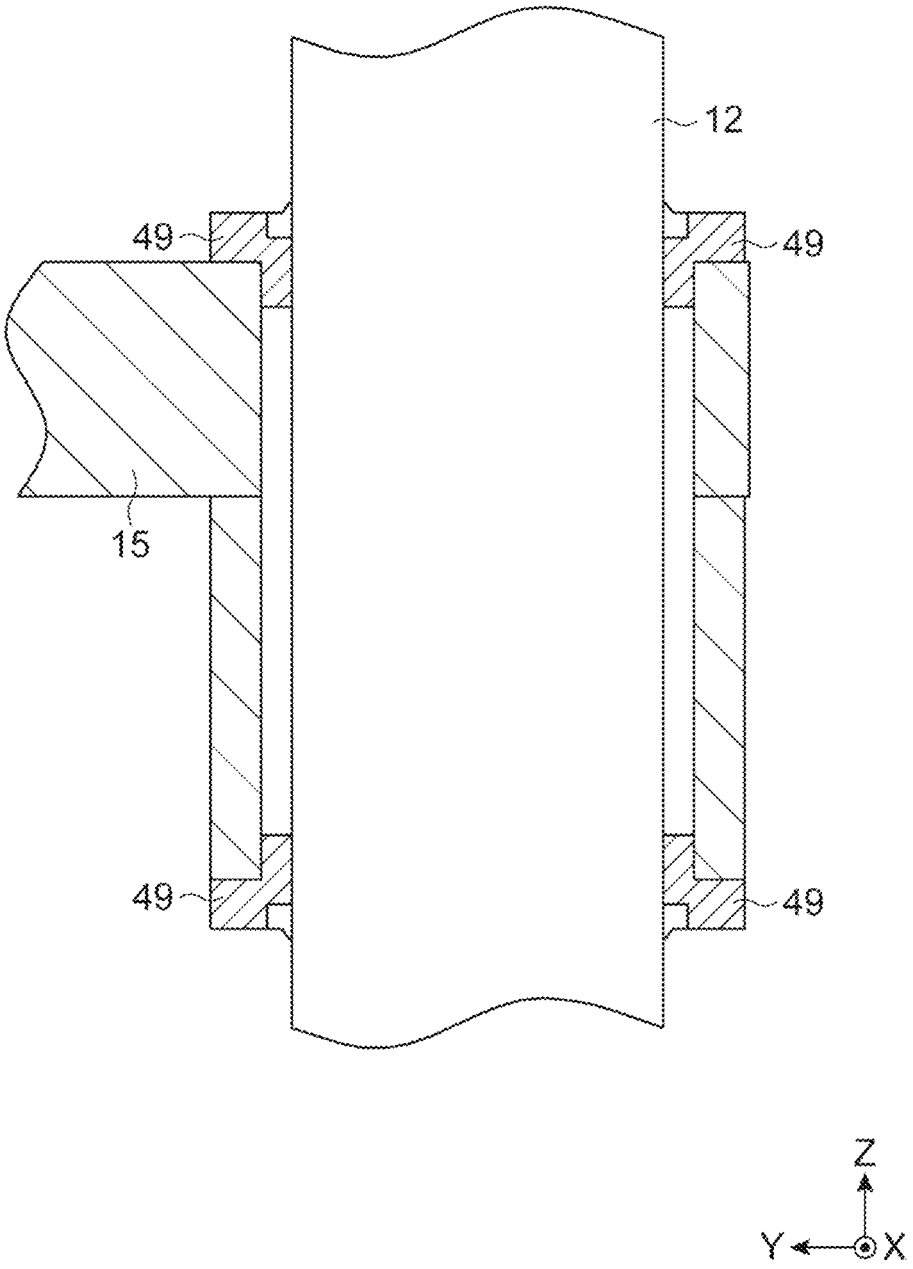
FIG. 15 is a sectional view of FIG. 14.
Figure 16:
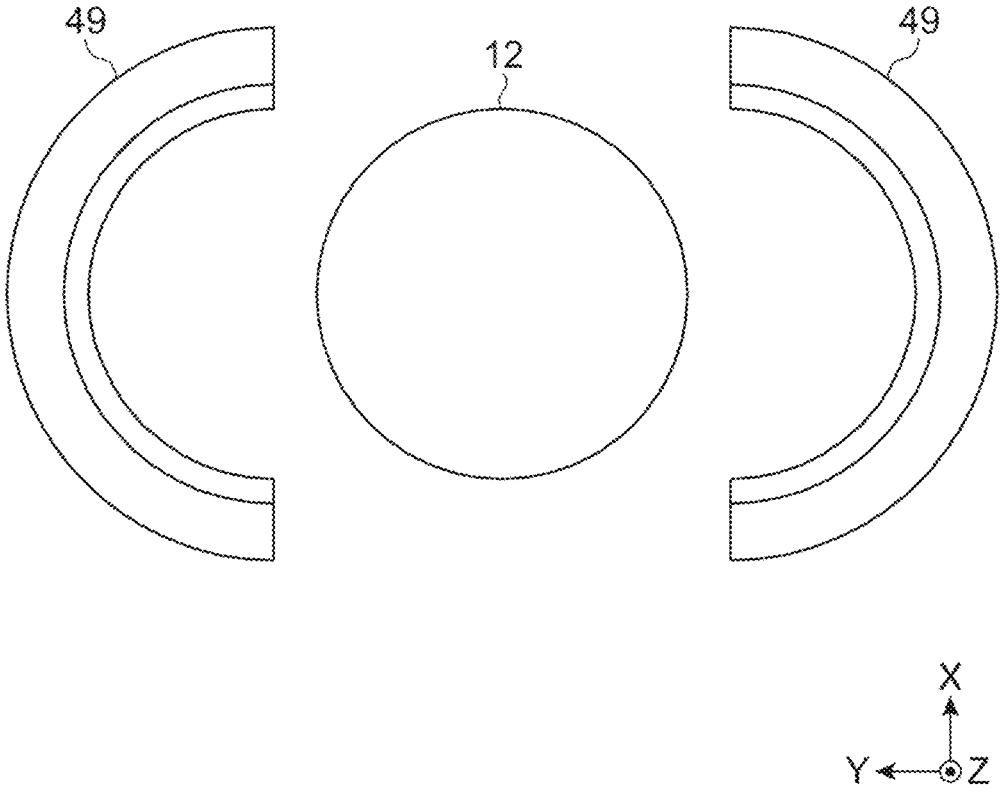
FIG. 16 is a plan view illustrating detachment of the bush.
Figure 17:
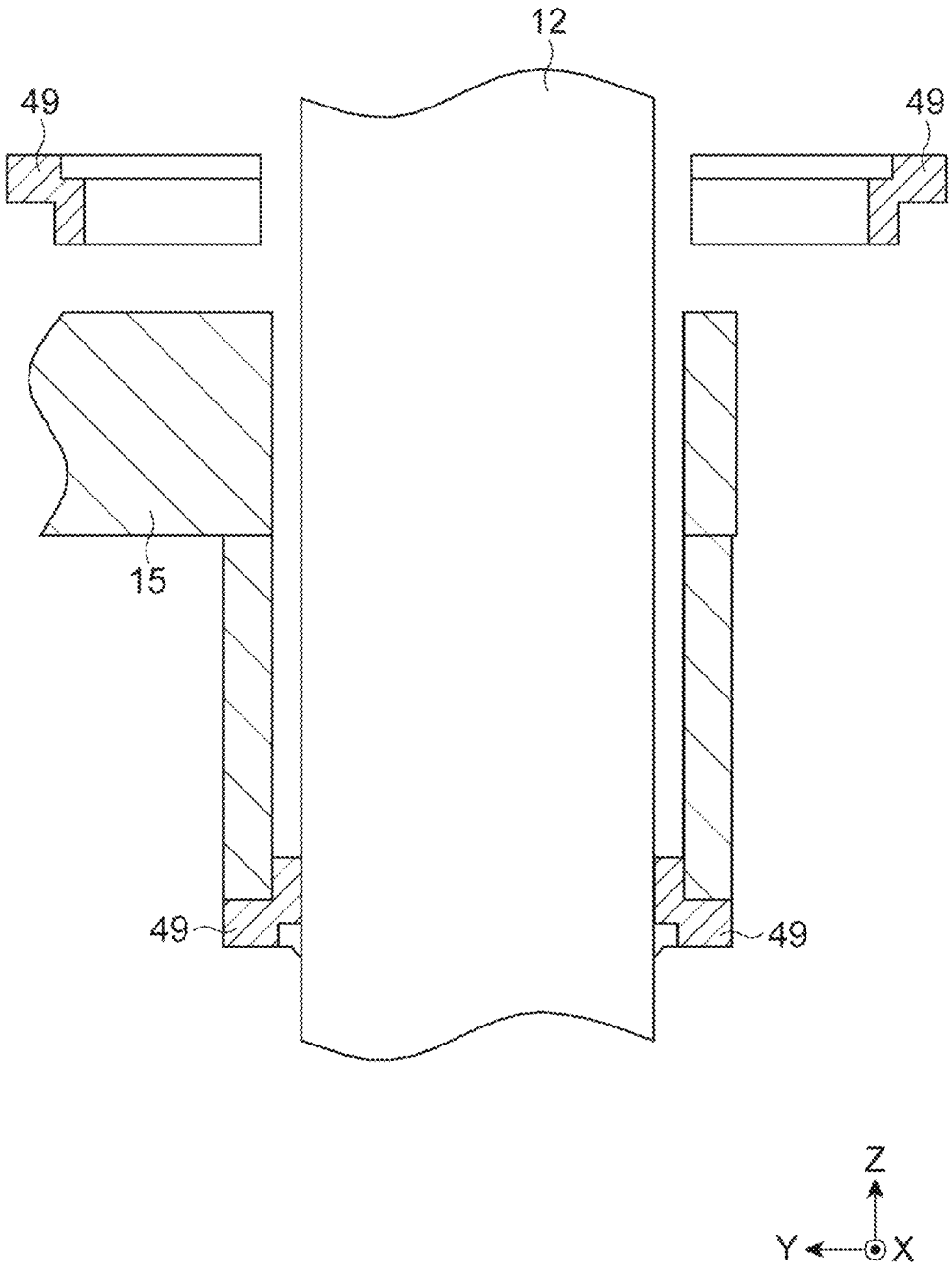
FIG. 17 is a sectional view illustrating detachment of the bush.

The upper flask 15, the lower flask 17 and the second lower sand tank 31 are movably attached to the four guides 12 through cylindrical bushes. For example, the upper flask 15 is described. FIG. 14 is a schematic diagram illustrating the bushes 49. FIG. 15 is a sectional view of FIG. 14. As shown in FIGS. 14 and 15, the bushes 49 are attached to the upper flask 15 at its upper and lower ends, thereby movably attached to the guides 12. The cylindrical bush 49 may be configured by combining a plurality of members. More specifically, the bush 49 may be configured by combining members halved by a plane parallel to the axial direction. FIG. 16 is a plan view illustrating detachment of the halved bushes 49. FIG. 17 is a sectional view illustrating detachment of the halved bushes 49. As shown in FIGS. 16 and 17, by adopting the halved bushes 49, replacement can be achieved with only the bushes 49 being detached without detaching the upper flask 15, the lower flask 17 and the second lower sand tank 31 from the guide 12. Consequently, the maintainability is excellent.

[Control Device]

The flaskless molding machine 1 may include a control device 50. The control device 50 is a computer that includes a control unit such as a processor, a storage unit such as a memory, an input and output unit such as an input device and a display device, and a communication unit such as a network card, and controls each of units of the flaskless molding machine 1, for example, a mold sand supply system, a compressed air supply system, a drive system, a power source system and the like. The control device 50 allows an operator to perform a command input operation and the like in order to manage the flaskless molding machine 1, using the input device, and can cause the display device to visualize and display the operation situations of the flaskless molding machine 1. Furthermore, the storage unit of the control device 50 stores a control program for allowing the processor to control various processes to be executed by the flaskless molding machine 1, and a program for causing each configuration unit of the flaskless molding machine 1 to execute processes according to a molding condition.

[Molding Process]

Figure 18:
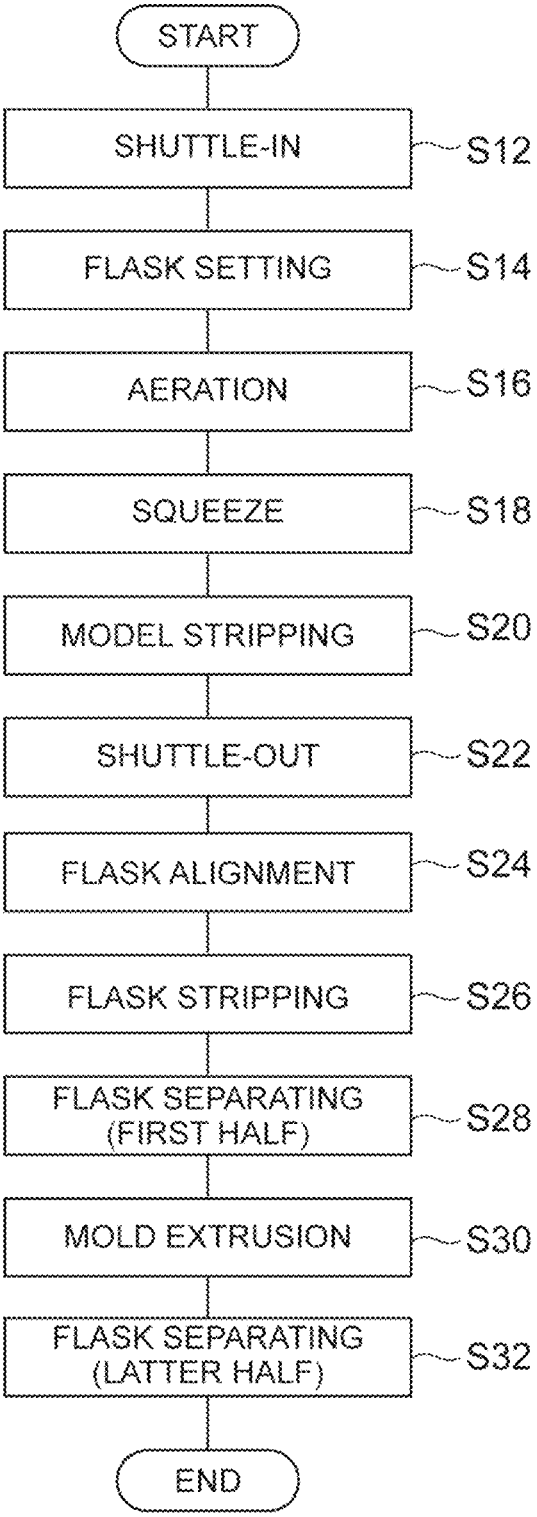
FIG. 18 is a flowchart illustrating a molding process of the flaskless molding machine according to one embodiment.

An overview of a molding process according to this embodiment is described. FIG. 18 is a flowchart illustrating the molding process of the flaskless molding machine according to one embodiment. The molding process shown in FIG. 18 is a process of molding a pair of the upper mold and the lower mold. The molding process shown in FIG. 18 is automatically activated with a condition that the attitude of the flaskless molding machine 1 is the original position (initial position). When the attitude of the flaskless molding machine 1 is not at the original position, this machine is manually operated to be moved to the original position. When an automatic activation button is pressed with the attitude (original position) of the flaskless molding machine 1 shown in FIG. 3, the molding process shown in FIG. 18 is started.

Figure 19:
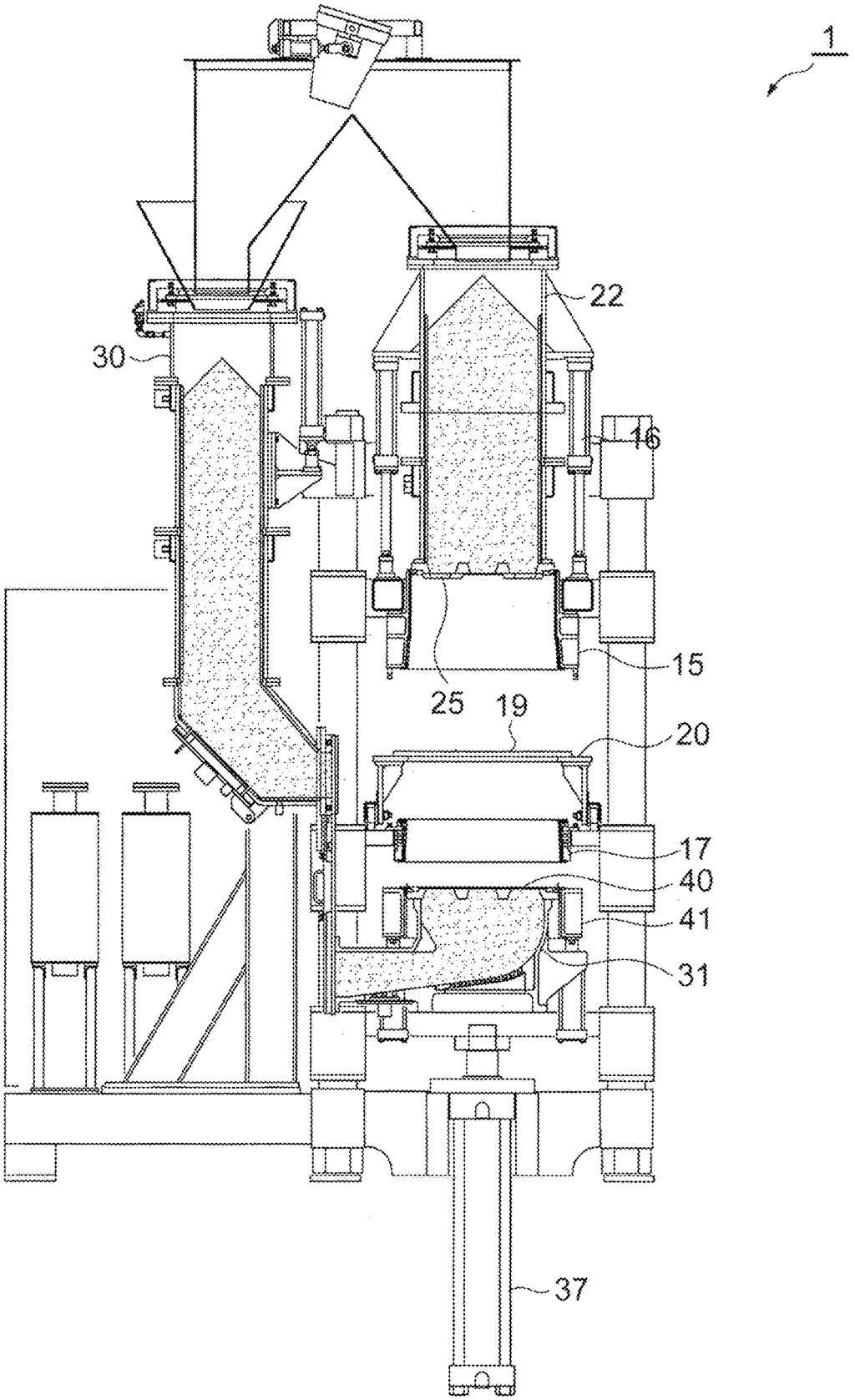
FIG. 19 is a schematic diagram illustrating a shuttle-in process.

When the molding process is started, a shuttle-in process (S12) is performed first. FIG. 19 is a schematic diagram illustrating the shuttle-in process. As shown in FIG. 19, in the shuttle-in process, the conveyance cylinder 21 moves the conveyance plate 20 mounted with the match plate 19 to a molding position.

Figure 20:
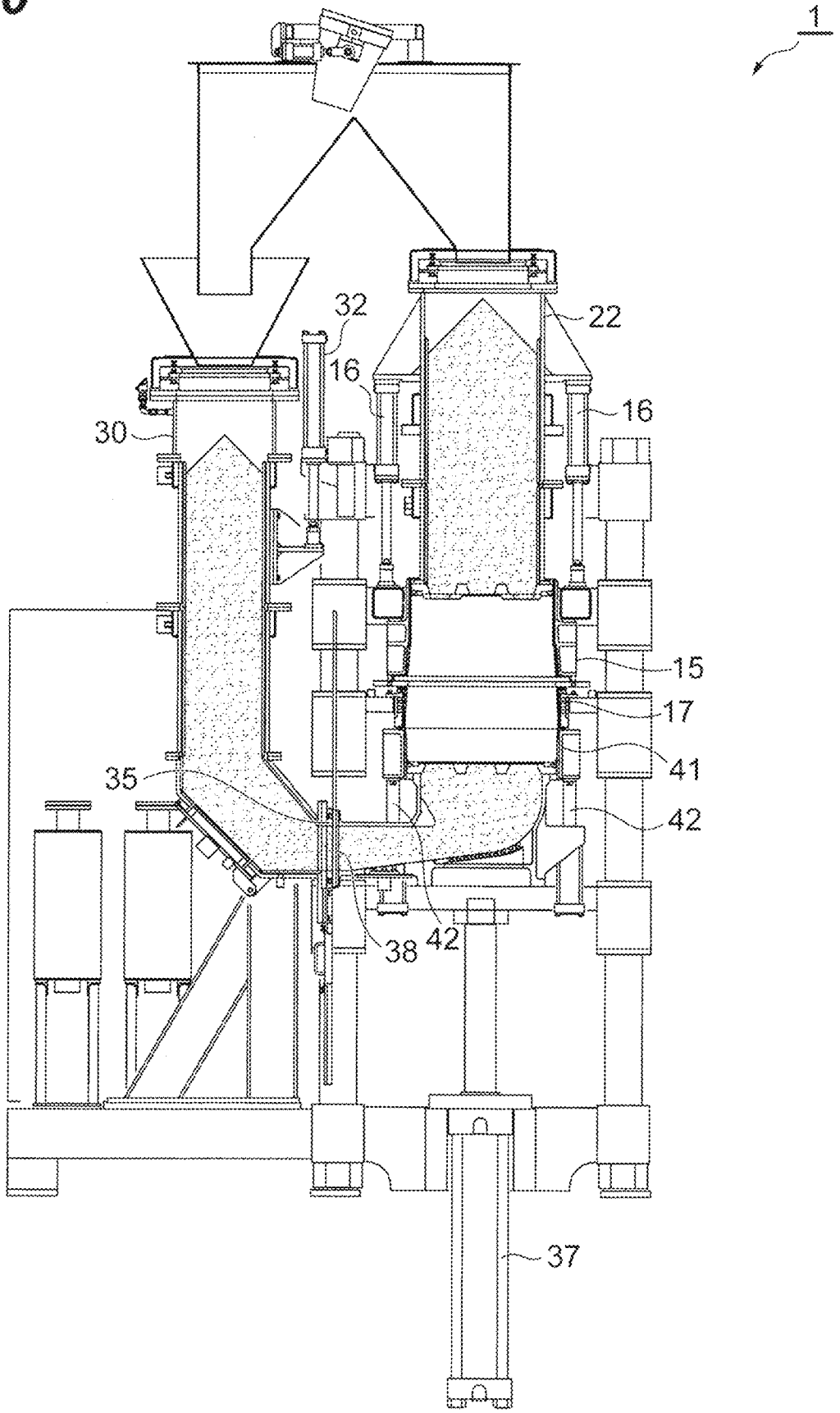
FIG. 20 is a schematic diagram illustrating a flask setting process.

Next, a flask setting process (S14) is performed. FIG. 20 is a schematic diagram illustrating the flask setting process. As shown in FIG. 20, in the flask setting process, the upper flask cylinder 16, the lower flask cylinders 18 (FIG. 2), the lower filling frame cylinder 42 and the squeeze cylinder 37 are elongated and contracted in conformity with the thicknesses of the molds to be formed. Accordingly, the upper flask 15 is moved to the predetermined position, and the lower flask 17 comes into contact with the match plate 19, and subsequently, the lower flask 17 mounted with the match plate 19 is moved to the predetermined position, thereby achieving a state where the match plate 19 is clamped between the upper flask 15 and the lower flask 17. The second lower sand tank 31 and the lower filling frame 41 then rise, and the lower filling frame 41 comes into contact with the lower flask 17. The lower tank cylinder 32 is elongated and contracted to move the first lower sand tank 30 in the vertical direction, thereby achieving a state where the height of the first communication port 35 of the first lower sand tank 30 coincides with the height of the second communication port 38 of the second lower sand tank 31. At this time, the upper molding space and the lower molding space are in a state (height) determined by the control device 50.

Figure 21:
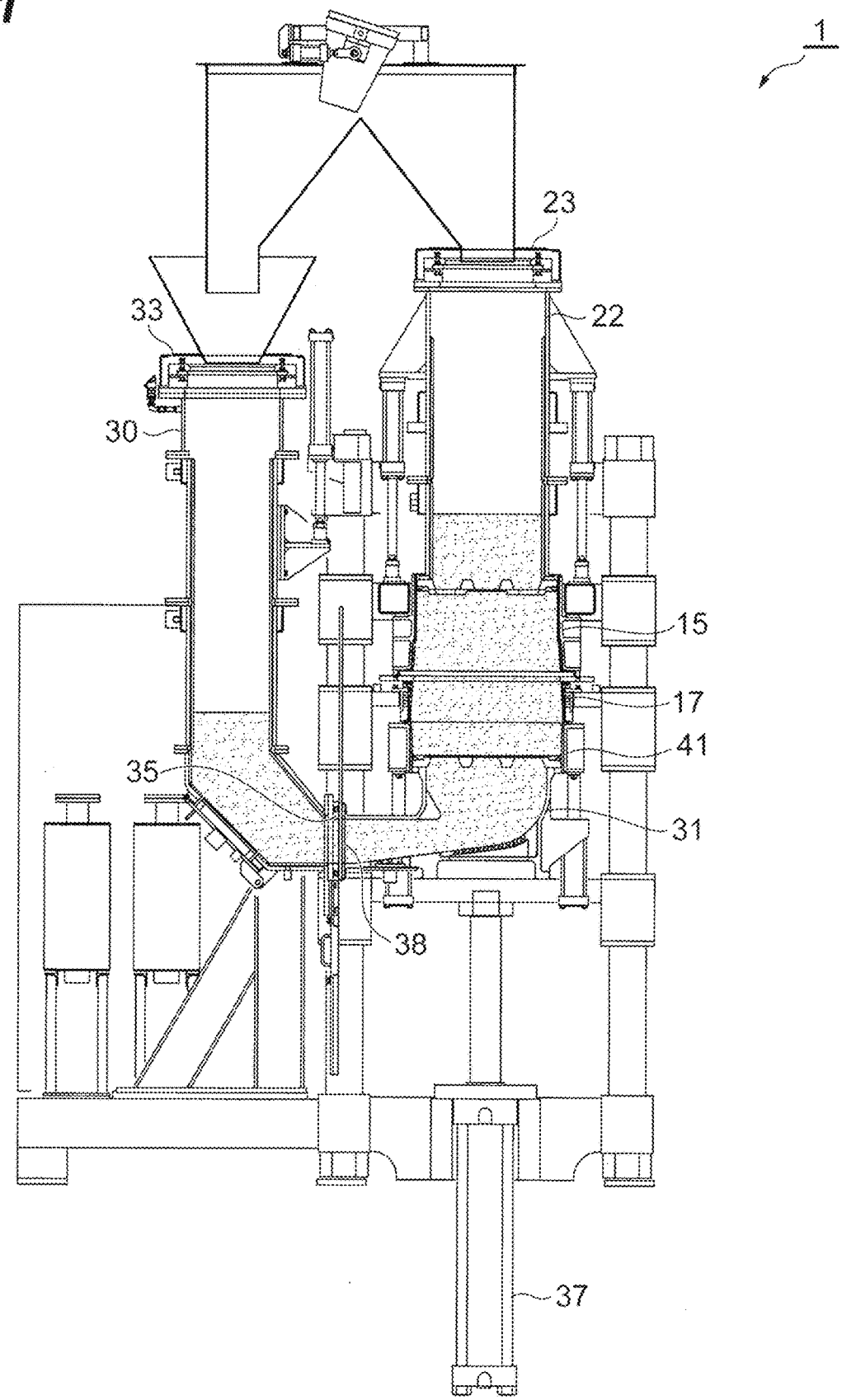
FIG. 21 is a schematic diagram illustrating an aeration process.

Next, an aeration process (S16) is performed. FIG. 21 is a schematic diagram illustrating the aeration process. As shown in FIG. 21, in the aeration process, the sealing mechanism seals the first communication port 35 of the first lower sand tank 30 and the second communication port 38 of the second lower sand tank 31. The slide gate 23 of the upper sand tank 22 and the slide gate 33 of the first lower sand tank 30 are then closed, and the compressed air source and the electro-pneumatic proportional valve supply compressed air to the upper sand tank 22 and the first lower sand tank 30. Accordingly, the upper molding space and the lower molding space are filled with the mold sand while the mold sand is allowed to flow. For example, if the set pressure and time are satisfied, the aeration process is finished.

Figure 22:
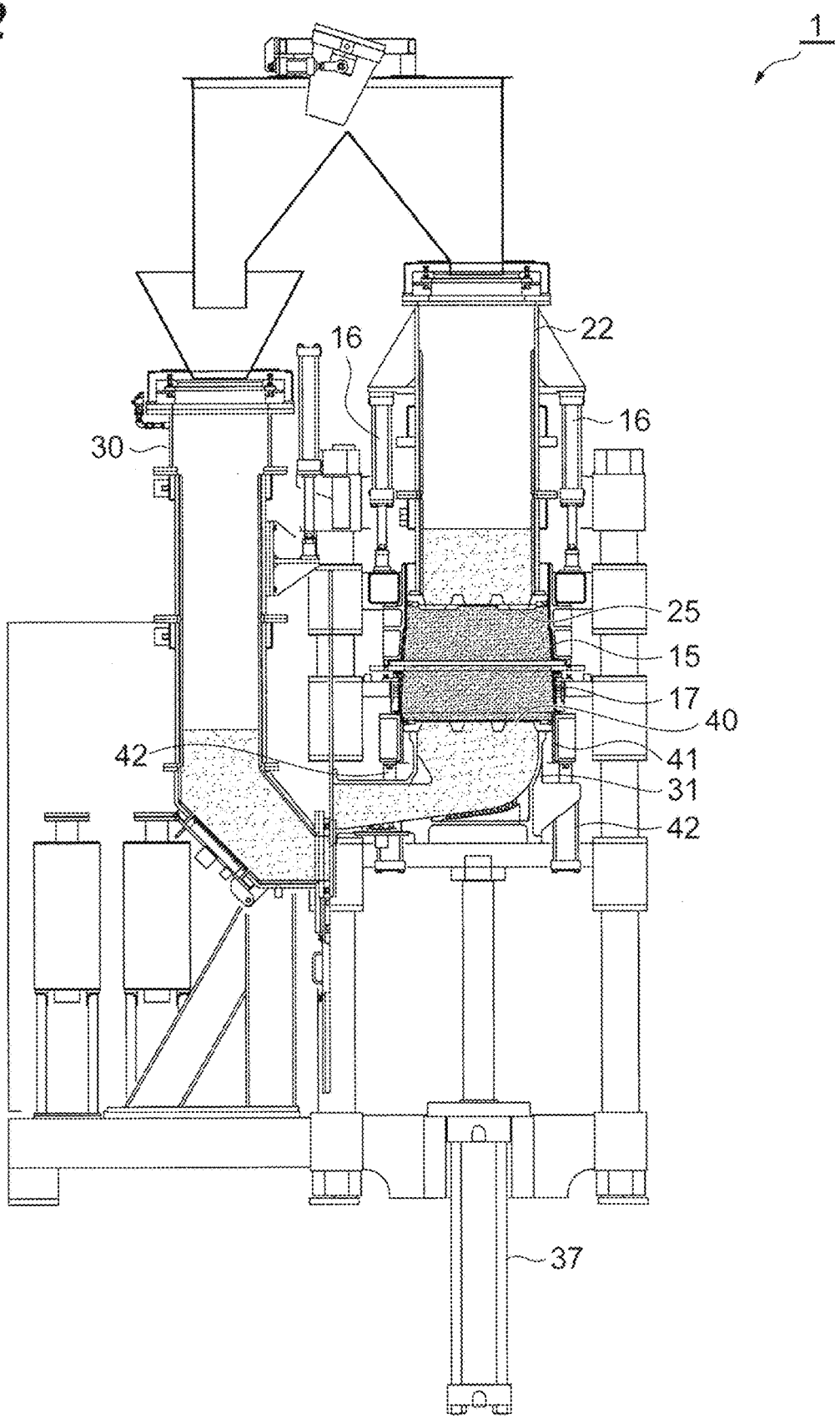
FIG. 22 is a schematic diagram illustrating a squeeze process.

Next, a squeeze process (S18) is performed. FIG. 22 is a schematic diagram illustrating the squeeze process. As shown in FIG. 22, in the squeeze process, the sealing mechanism having been operated in the aeration process (S16) releases the sealing, and the squeeze cylinder 37 is further elongated, thereby further raising the second lower sand tank 31. Accordingly, the lower plate 40 attached to the second lower sand tank 31 enters the inside of the lower filling frame 41 and compresses the mold sand in the lower molding space, while the upper plate 25 enters the inside of the upper flask 15 and compresses the mold sand in the upper molding space. In a case where the squeeze cylinder 37 is controlled by an oil-hydraulic circuit, the squeeze process is finished when the oil pressure of the oil-hydraulic circuit can be determined to be the same as the set oil pressure, for example. It should be noted that in a case where during the squeeze process, the upper flask cylinder 16, the lower flask cylinders 18 and the lower filling frame cylinder 42 are controlled by the oil-hydraulic circuit, each cylinder is set as a free circuit. Accordingly, each cylinder yields to the squeeze force and is contracted.

Figure 23:
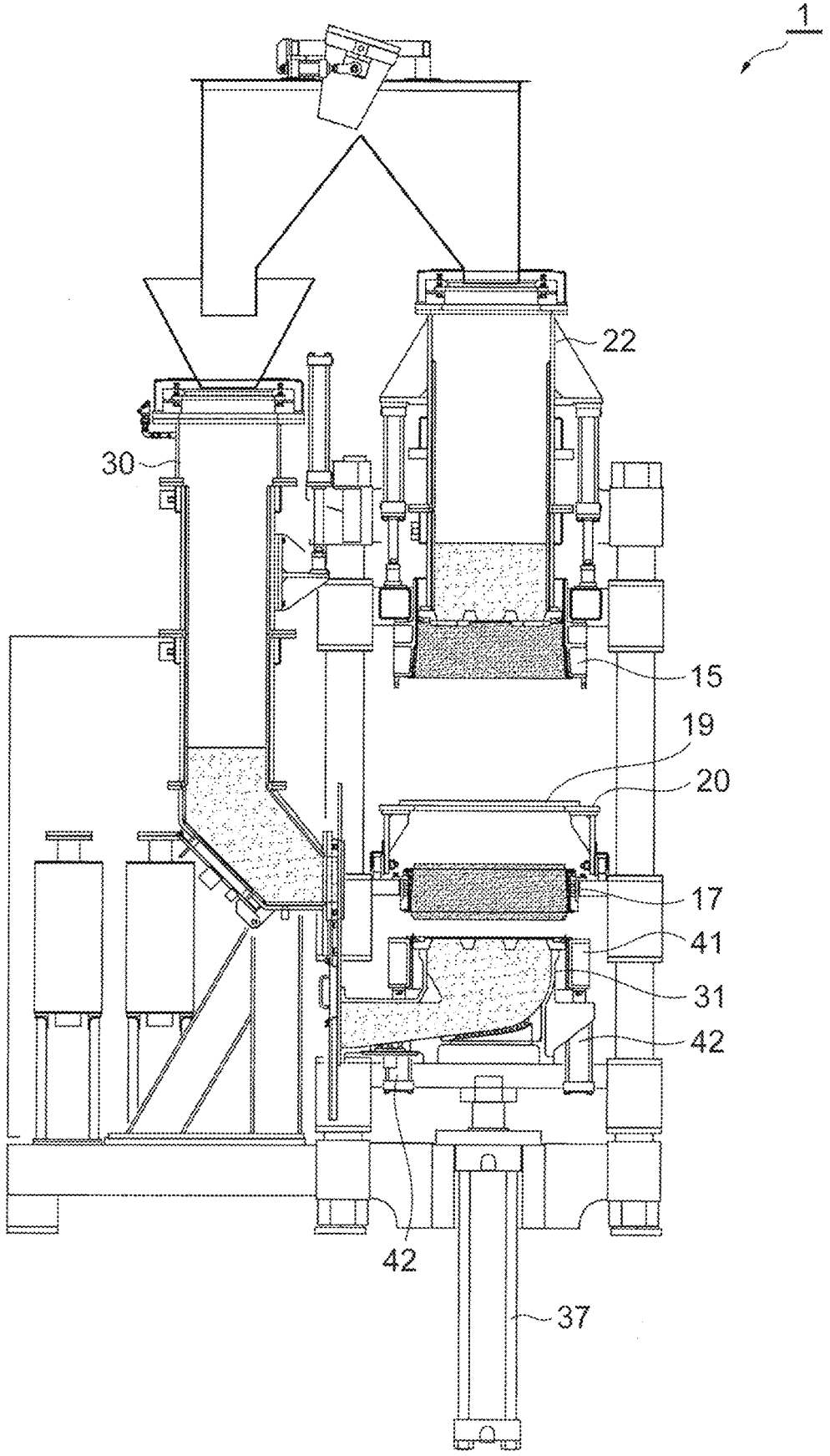
FIG. 23 is a schematic diagram illustrating a model-stripping process.

Next, a model-stripping process (S20) is performed. FIG. 23 is a schematic diagram illustrating the model-stripping process. As shown in FIG. 23, in the model-stripping process, the lower filling frame cylinder 42 is contracted to lower the lower filling frame 41. Subsequently, the squeeze cylinder 37 is contracted and lowers the second lower sand tank 31, and subsequently lowers the lower flask 17 mounted with the match plate 19 and the conveyance plate 20. The model is then stripped from the upper flask 15. When the lower flask 17 is lowered to a fixed unit (not shown), the match plate 19 and the conveyance plate 20 are supported by the fixed unit. Accordingly, the model is stripped from the lower flask 17.

Figure 24:
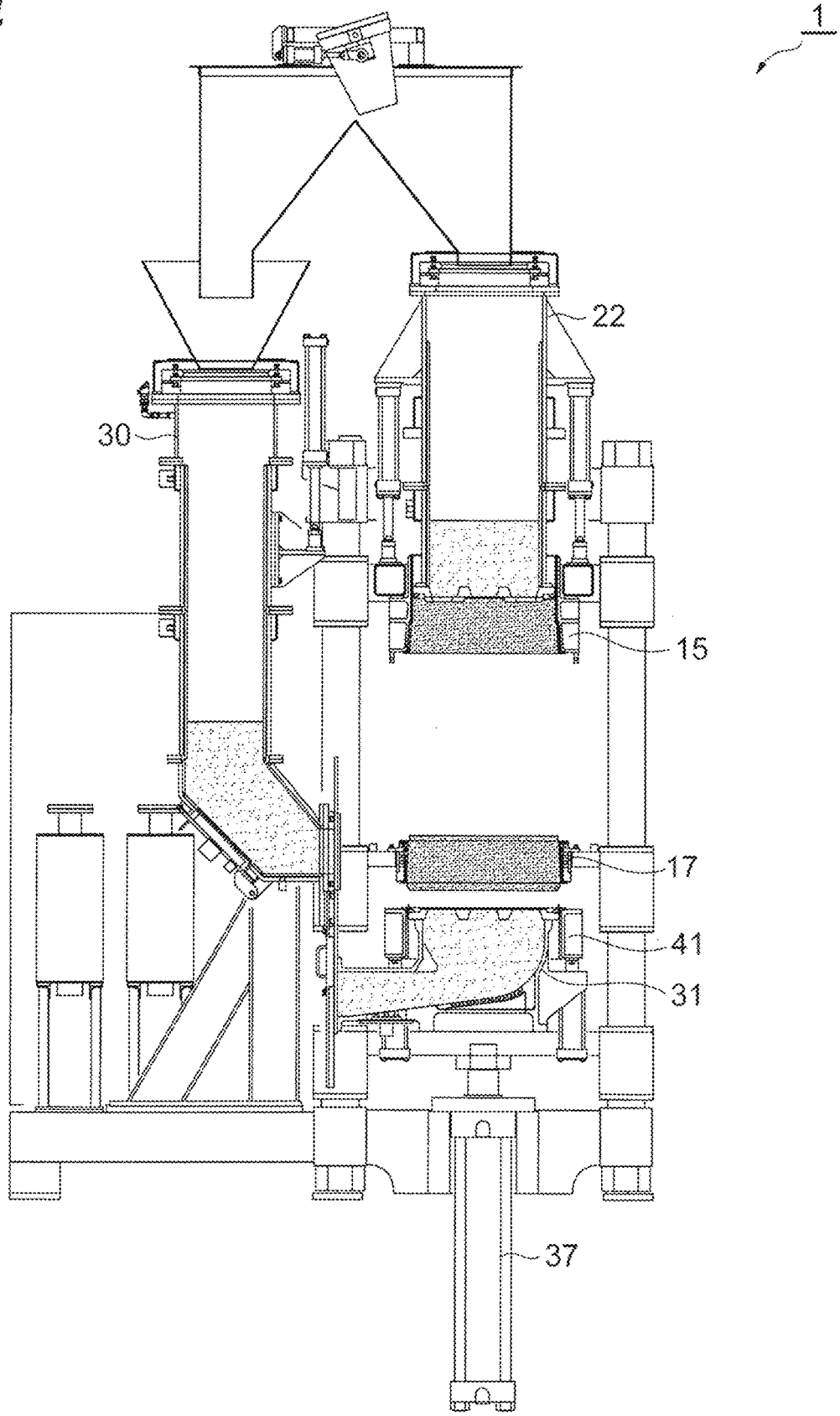
FIG. 24 is a schematic diagram illustrating a shuttle-out process.

Next, a shuttle-out process (S22) is performed. FIG. 24 is a schematic diagram illustrating the shuttle-out process. As shown in FIG. 24, in the shuttle-out process, the conveyance cylinder 21 is contracted, thereby moving the conveyance plate 20 to the retracted position. In the state shown in FIG. 24, a core is disposed in the upper flask 15 or the lower flask 17 if necessary.

Figure 25:
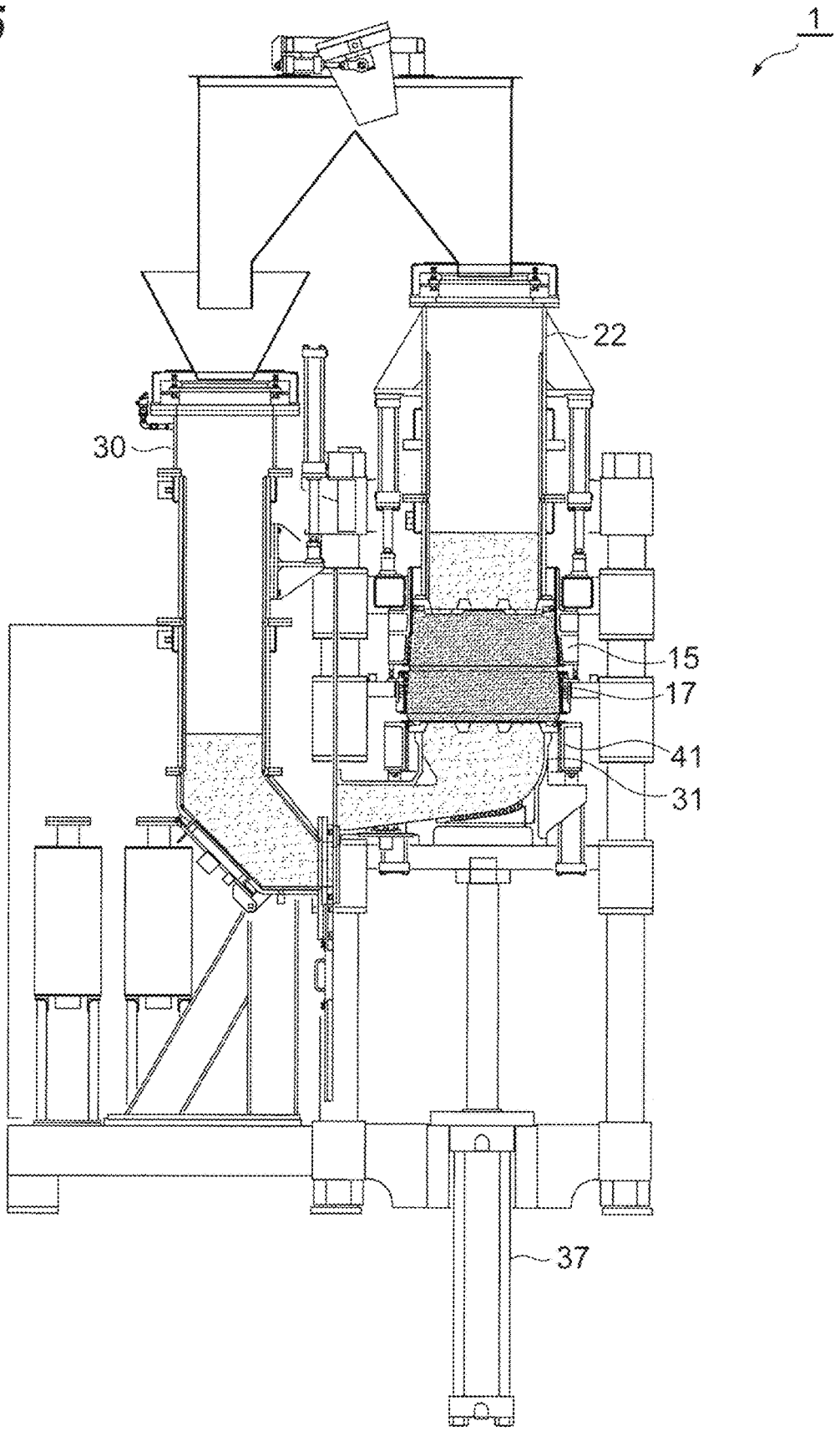
FIG. 25 is a schematic diagram illustrating a flask alignment process.

Next, a flask alignment process (S24) is performed. FIG. 25 is a schematic diagram illustrating the flask alignment process. As shown in FIG. 25, in the flask alignment process, the lower flask cylinders 18 are contracted to elongate the squeeze cylinder 37, thereby raising the lower flask 17 and the second lower sand tank 31 to align the flask.

Figure 26:
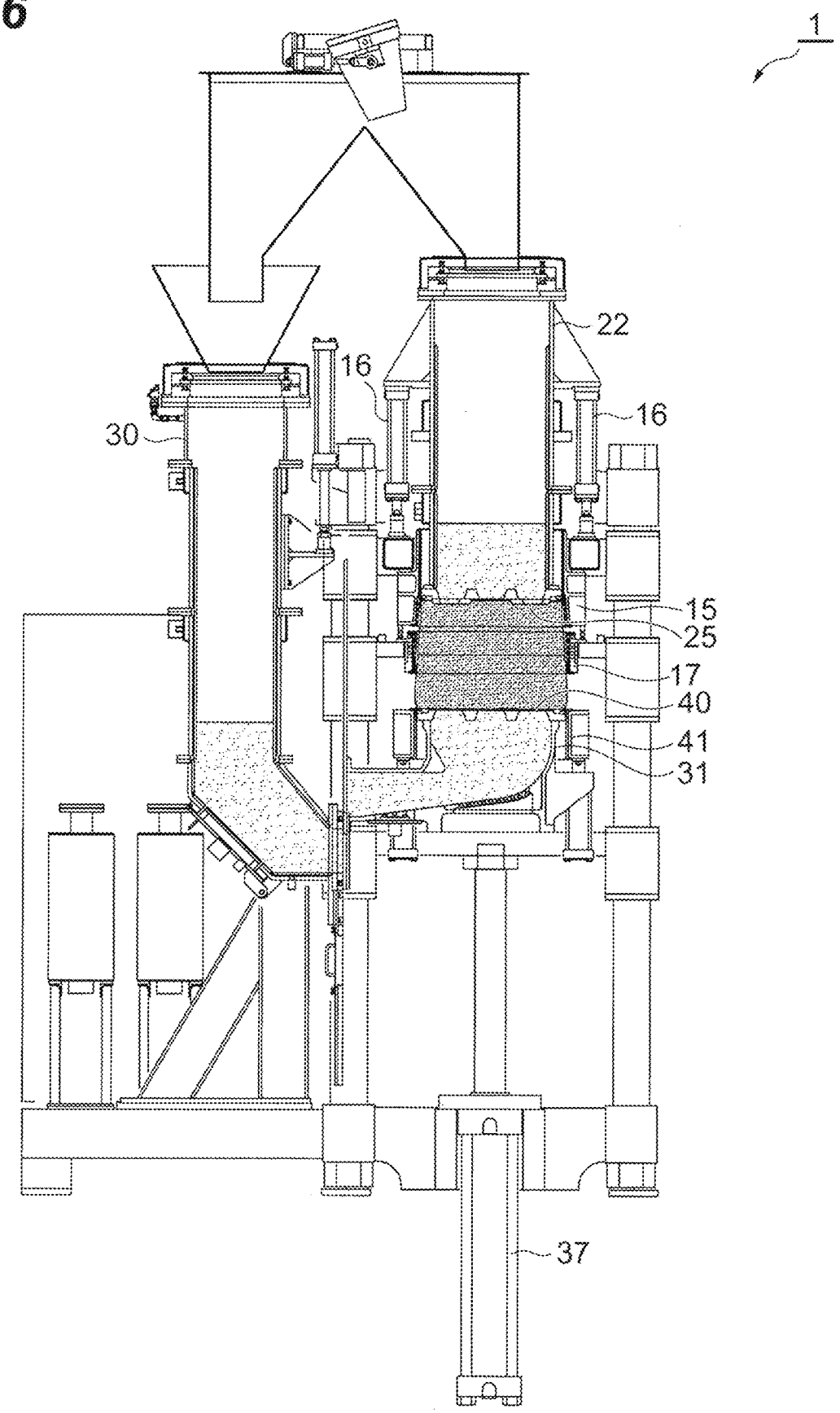
FIG. 26 is a schematic diagram illustrating the flask-stripping process.

Next, the flask-stripping process (S26) is performed. FIG. 26 is a schematic diagram illustrating the flask-stripping process. As shown in FIG. 26, in the flask-stripping process, the upper flask cylinder 16 and the lower flask cylinders 18 are contracted, thereby raising the upper flask 15 and the lower flask 17 to the raised ends to strip the flask.

Figure 27:
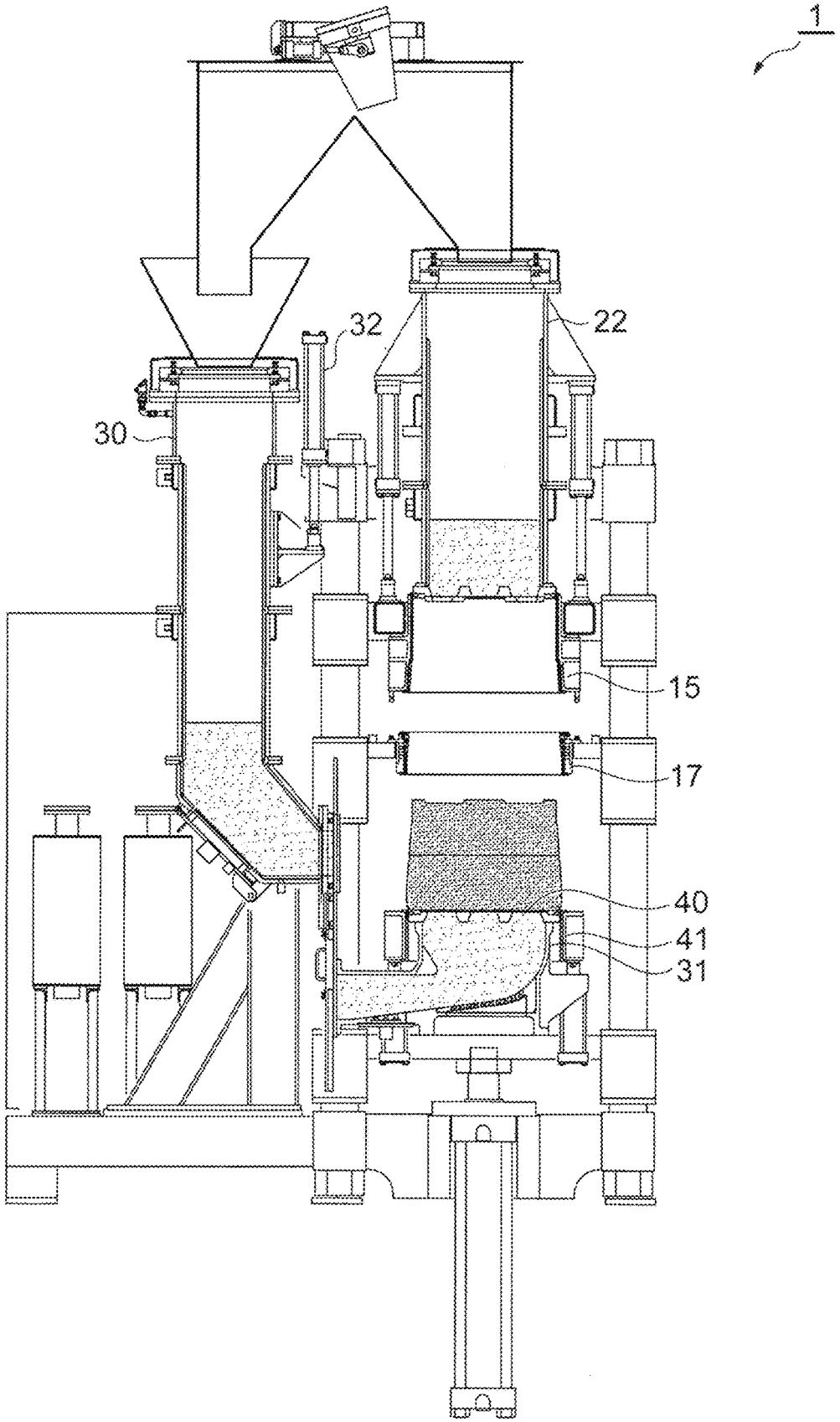
FIG. 27 is a schematic diagram illustrating a first flask separating process (first half).

Next, a first flask separating process (S28) is performed. FIG. 27 is a schematic diagram illustrating the first flask separating process (first half). As shown in FIG. 27, in the first flask separating process, in a state where the mold is mounted on the lower plate 40 of the second lower sand tank 31, the squeeze cylinder 37 is contracted to lower the second lower sand tank 31. At this time, the lower flask cylinders 18 are elongated to lower the lower flask 17, and the mold is stopped at a position of not interfering with conveyance of the mold.

Figure 28:
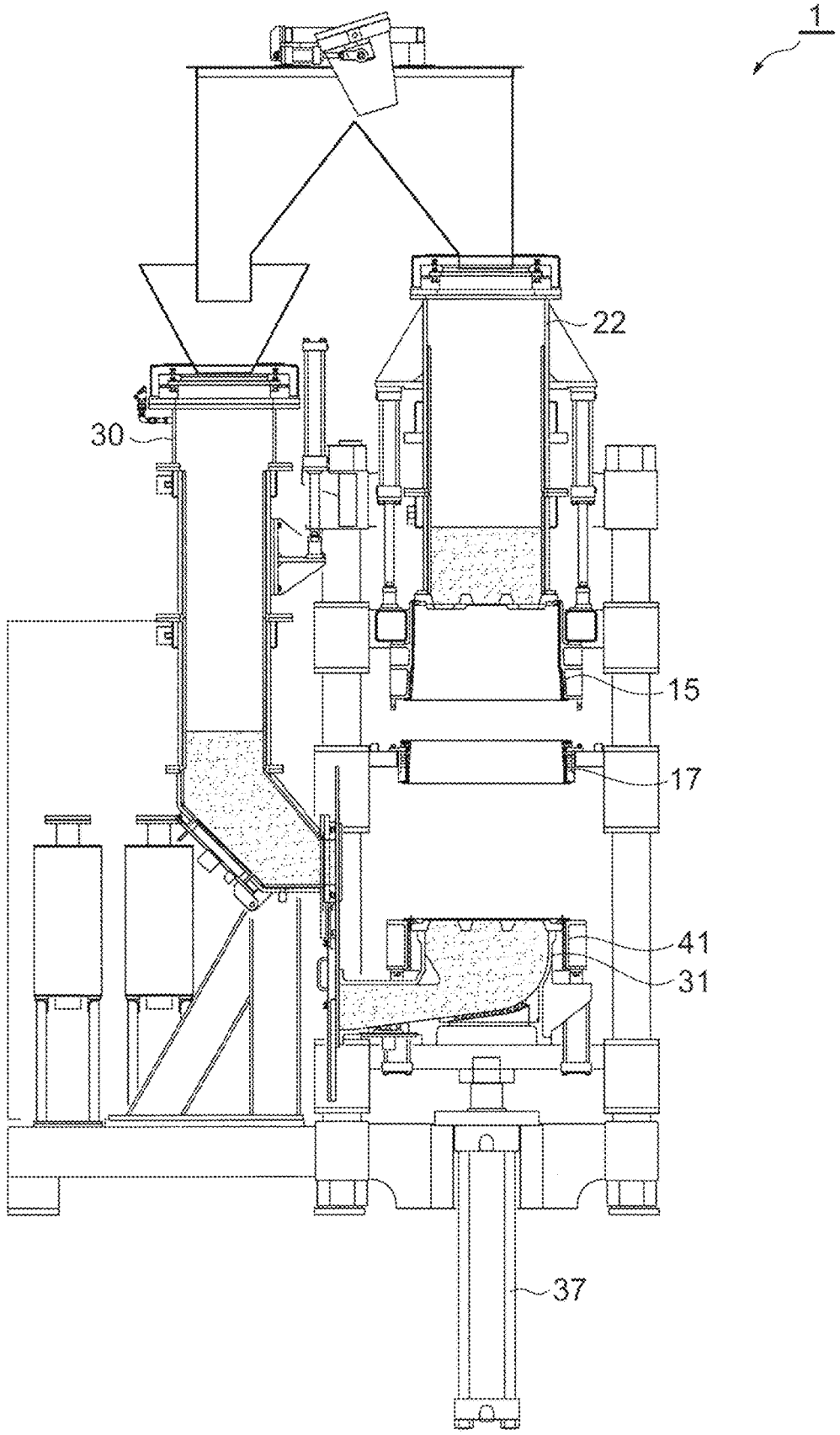
FIG. 28 is a schematic diagram illustrating a mold extrusion process.

Next, a mold extrusion process (S30) is performed. FIG. 28 is a schematic diagram illustrating the mold extrusion process. As shown in FIG. 28, in the mold extrusion process, an extrusion cylinder 48 (see FIG. 2) is elongated, thereby conveying the upper mold and the lower mold to the outside of the machine (e.g., a molding line).

Figure 29:
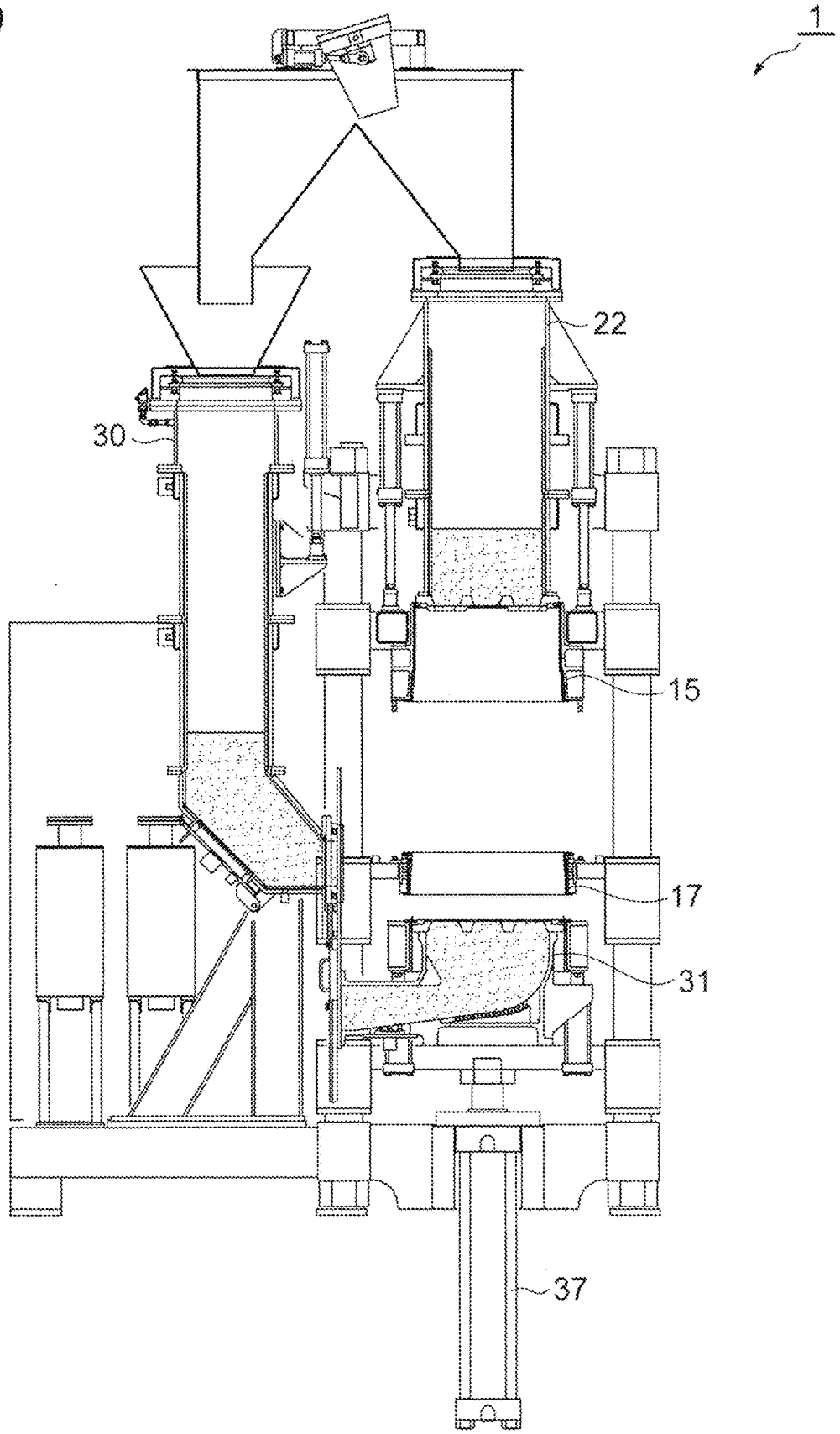
FIG. 29 is a schematic diagram illustrating a second flask separating process (latter half).

Next, a second flask separating process (S32) is performed. FIG. 29 is a schematic diagram illustrating the second flask separating process (latter half). As shown in FIG. 29, in the second flask separating process, the lower flask cylinders 18 are elongated to return the lower flask 17 to the original position.

As described above, the process of forming the pair of the upper mold and the lower mold is thus finished.

[Position Adjustment of First Lower Sand Tank]

Figure 30:
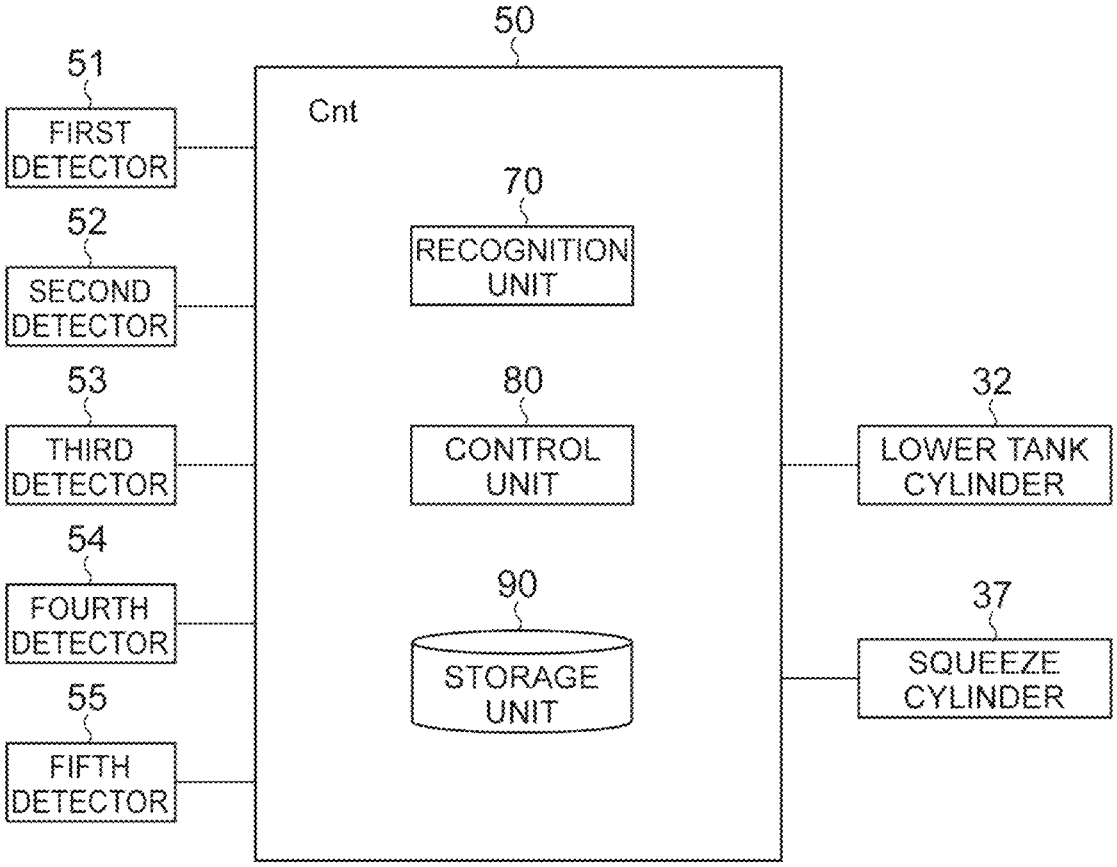
FIG. 30 is a functional block diagram of a control device of the flaskless molding machine according to one embodiment.

The details of the position adjustment of the first lower sand tank 30 performed in the flask setting process (S14) described above are described. The position adjustment is achieved by the control device 50. FIG. 30 is a functional block diagram of the control device 50 of the flaskless molding machine 1 according to one embodiment. As shown in FIG. 30, the control device 50 is connected to a first detector 51, a second detector 52, a third detector 53, a fourth detector 54, a fifth detector 55 and the lower tank cylinder 32. It should be noted that the control device 50 is not necessarily connected to all of the first detector 51 to fifth detector 55. For example, the control device 50 may be connected only to the first detector 51 and the second detector 52, or may be connected only to the third detector 53 to fifth detector 55. The flaskless molding machine 1 does not necessarily include all of the first detector 51 to fifth detector 55.

Figure 31:
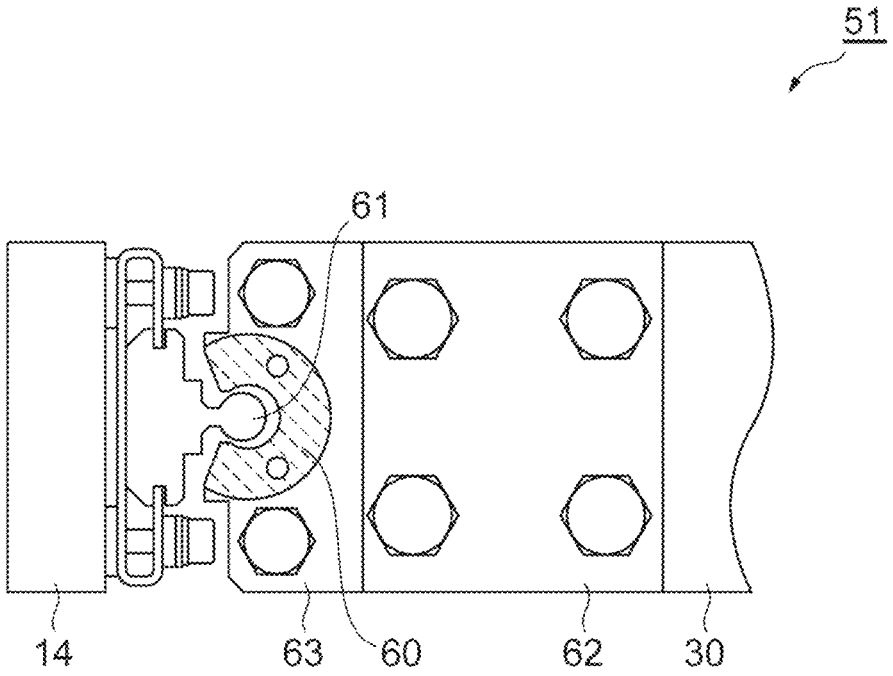
FIG. 31 is a top view showing one example of a first detector.
Figure 32:
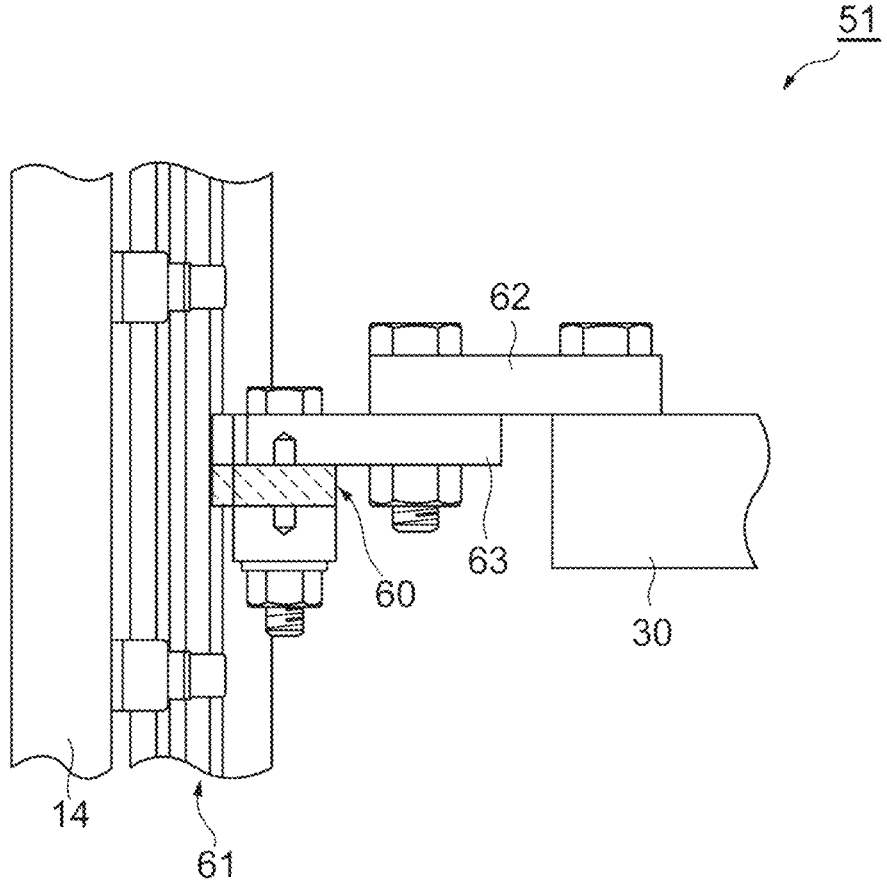
FIG. 32 is a front view showing the example of the first detector.

The first detector 51 detects the height position of the first lower sand tank 30. FIG. 31 is a top view showing one example of the first detector 51. FIG. 32 is a front view showing the one example of the first detector 51. As shown in FIGS. 31 and 32, the first detector 51 includes a magnet 60 and a magnetic field detecting portion 61. The magnet 60 is attached to members 62 and 63 that move together with the first lower sand tank 30. The magnet 60 may be attached directly to the first lower sand tank 30. The magnet 60 is a partially cut annular member. The magnetic field detecting portion 61 is attached to the support frame 14 serving as a fixed frame, consists of a longitudinal member extending in the vertical direction, and detects the magnetic field caused with the magnet 60. The magnetic field detecting portion 61 is provided along the movement direction of the first lower sand tank 30. The magnet 60 is disposed so that the magnetic field detecting portion 61 can be positioned inside. As the magnet 60 moves together with the first lower sand tank 30, the first detector 51 can detect the height position (absolute position) of the first lower sand tank 30 by detecting the magnetic field position.

The second detector 52 detects the height position of the second lower sand tank 31 (lower plate 40). The configuration of the second detector 52 is the same as that of the first detector 51. Consequently, the description is omitted. It should be noted that in the case of the second detector 52, for example, the second lower sand tank 31 is provided with the magnet 60, while the fixed member, such as the frame of the molding unit A1, is provided with the magnetic field detecting portion 61.

The third detector 53 detects the height position of the upper flask 15. The configuration of the third detector 53 is the same as that of the first detector 51. Consequently, the description is omitted. It should be noted that in the case of the third detector 53, for example, the upper flask 15 is provided with the magnet 60, while the fixed member, such as the frame of the molding unit A1, is provided with the magnetic field detecting portion 61.

The fourth detector 54 detects the height position of the lower flask 17. The configuration of the fourth detector 54 is the same as that of the first detector 51. Consequently, the description is omitted. It should be noted that in the case of the fourth detector 54, for example, the lower flask 17 is provided with the magnet 60, while the fixed member, such as the frame of the molding unit A1, is provided with the magnetic field detecting portion 61.

The fifth detector 55 detects the height position of the lower filling frame 41. The configuration of the fifth detector 55 is the same as that of the first detector 51. Consequently, the description is omitted. It should be noted that in the case of the fifth detector 55, for example, the lower filling frame 41 is provided with the magnet 60, while the fixed member, such as the frame of the molding unit A1, is provided with the magnetic field detecting portion 61.

The control device 50 includes a recognition unit 70, a control unit 80, and a storage unit 90. The recognition unit 70 recognizes the height position of the moving first lower sand tank 30 (the height position of the first communication port 35), and the completion of movement, on the basis of a detection result of the first detector 51. The recognition unit 70 recognizes the height position of the moving second lower sand tank 31 (the height position of the second communication port 38), and the completion of movement, on the basis of a detection result of the second detector 52. The recognition unit 70 recognizes the height position of the moving upper flask 15, and the completion of movement, on the basis of a detection result of the third detector 53. The recognition unit 70 recognizes the height position of the moving lower flask 17, and the completion of movement, on the basis of a detection result of the fourth detector 54. The recognition unit 70 recognizes the height position of the moving lower filling frame 41, and the completion of movement, on the basis of a detection result of the fifth detector 55. As described above, the recognition unit 70 can recognize the height positions of the moving configuration elements and the completion of movement, on the basis of the results of the detectors. Furthermore, the recognition unit 70 can also recognize the thickness of the upper mold at the completion of squeeze, on the basis of the height position of the upper flask 15 detected by the third detector 53 at the completion of squeeze. Furthermore, the recognition unit 70 can also recognize the thickness of the lower mold at the completion of squeeze, on the basis of the height position of the second lower sand tank 31 (lower plate 40) detected by the second detector at the completion of squeeze, and the height position of the lower filling frame 41 detected by the fifth detector 55 at the completion of squeeze.

The recognition unit 70 causes the storage unit 90 to store the height position of the upper flask 15 detected by the third detector 53 at the completion of squeeze, the height position of the second lower sand tank 31 (lower plate 40) detected by the second detector at the completion of squeeze, and the height position of the lower filling frame 41 detected by the fifth detector 55 at the completion of squeeze, as molding results. At this time, the recognition unit 70 may associate the molding condition and the molding results with each other, and cause the storage unit 90 to store the associated condition and result. The molding condition is a condition preset in the case of molding and is, for example, the model number of the model, the model shape, the target height position of each configuration element and the like. As described above, the recognition unit 70 and the storage unit 90 obtain and store achievement information.

The control unit 80 determines the height position of the upper flask 15 and the height position of the lower filling frame 41 at the next filling with sand, on the basis of the last molding result stored in the storage unit 90. As described above, the control unit 80 performs feedback control on the basis of the detection results of the third detector 53 and the fifth detector 55.

It should be noted that the recognition unit 70 may store not only the detection results of the third detector 53 and the fifth detector 55, but also the detection results of another combination selected from among the first detector 51 to fifth detector 55, all the detection results, or the thicknesses of the upper mold and the lower mold, as the molding results, in the storage unit 90. In this case, the control unit 80 can perform feedback control different from the feedback control described above, on the basis of the molding results stored in the storage unit 90. For example, the control unit 80 may determine the height position of the first lower sand tank 30 and the height position of the second lower sand tank 31 at the next filling with sand, on the basis of the height position of the first lower sand tank 30 (the height position of the first communication port 35) detected by the first detector 51 at the completion of squeeze and the height position of the second lower sand tank 31 (the height position of the second communication port 38) detected by the second detector 52 at the completion of squeeze. Accordingly, the control unit 80 can operate the squeeze cylinder 37 and the lower tank cylinder 32 so that the height positions of the first communication port 35 and the second communication port 38 can coincide with each other, on the basis of the detection results of the first detector 51 and the second detector 52.

Figure 33:
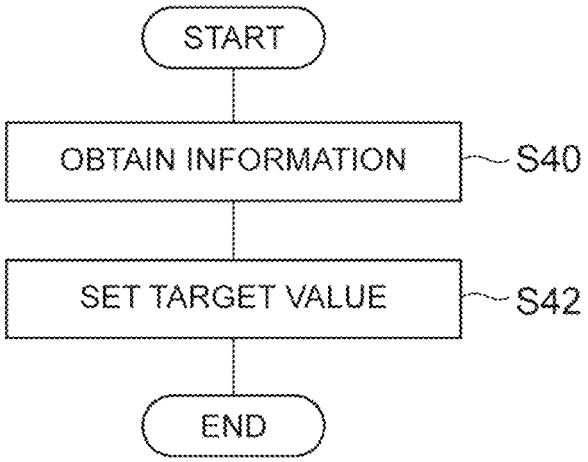
FIG. 33 is a flowchart illustrating a target setting process of the flaskless molding machine according to one embodiment.

FIG. 33 is a flowchart illustrating a target setting process of the flaskless molding machine 1 according to one embodiment. The process shown in FIG. 33 is executed in the flask setting process (S14). First, the control unit 80 obtains the last molding results stored in the storage unit 90, in an information obtaining process (S40). Next, the control unit 80 determines the target value of the height position of the first communication port 35, in a target value setting process (S42). For example, in a case where there is a difference between the last height position of the first communication port 35 and the last height position of the second communication port 38, the control unit 80 determines the target value of the height position of the first communication port 35 in such a way as to cancel the difference. As described above, the target setting process of the flaskless molding machine 1 is thus finished.

As described above, the flaskless molding machine 1 according to this embodiment allows the control unit 80 operating the lower tank cylinder 32 to adjust the height of the first communication port 35 of the first lower sand tank 30 in such a way to coincide with the height of the second communication port 38 of the second lower sand tank 31. Accordingly, the flow of mold sand at the communication portion between the first communication port 35 and the second communication port 38 becomes uniform, and occurrence of sand clogging can be suppressed. Consequently, the need to adjust the CB of mold sand in consideration of sand clogging is negated. The mold sand optimal to the moldability of a mold and the quality of a casting product can be used. Resultantly, the excellent mold and casting product can be obtained.

The flaskless molding machine 1 according to this embodiment can achieve mold sand filling and squeezing at the lower flask 17 by vertically moving only the divided second lower sand tank 31. In a case where the first lower sand tank 30 adopts an integral sand tank fixedly communicating with the second lower sand tank 31, a heavier load is applied to the left side of the tank than to the right side. Consequently, there is a possibility that the degree during the tank being raised is different from the degree during being lowered. There is a possibility that such a difference in degree causes a model-stripping failure when the mold is stripped from the pattern. On the contrary, the flaskless molding machine 1 according to this embodiment can reduce the inclination due to a load imbalance. Consequently, an excellent mold and casting product can be obtained as a result.

Furthermore, the flaskless molding machine 1 according to this embodiment supplies the compressed air to a storage space from the side through the entire surfaces of the permeation members 22*a* and 30*a*. Consequently, the fluidity of mold sand is improved. In this state, the mold sand is then blown into the upper flask or the lower flask by the compressed air, thereby allowing the blowing resistance of the mold sand to be reduced. Consequently, the power consumption of the compressed air source can be suppressed, and occurrence of sand clogging can be suppressed.

Furthermore, the flaskless molding machine 1 according to this embodiment adjusts the height position of the second lower sand tank 31 on the basis of the last molding result. Consequently, this machine can align the height positions of the first communication port 35 and the second communication port 38 with each other more accurately.

The flaskless molding machine 1 according to this embodiment can contactlessly recognize the positions of the first lower sand tank 30 and the second lower sand tank 31.

Moreover, in the flaskless molding machine 1 according to this embodiment, the mold sand with which the upper molding space and the lower molding space are to be filled is mold sand configured to be in a range where the CB of 30% to 42% and the compressive strength of mold sand of 8 to 15 N/cm$^2$. Consequently, the excellent mold and casting product can be obtained.

It should be noted that the embodiment described above is an example of the flaskless molding machine according to the present invention. The flaskless molding machine according to the present invention is not limited to the flaskless molding machine 1 according to the embodiment, and may be what is achieved by modifying the flaskless molding machine 1 according to the embodiment or by application to another machine in a range without changing the gist described in each claim.

For example, in the embodiment described above, the example where the upper sand tank 22 is fixed to the upper frame 10 is described. Alternatively, the upper sand tank 22 may be configured to be movable.

In the embodiment described above, the control device 50 may control the movement speeds of the first lower sand tank 30 and the second lower sand tank 31 using the detection results of the first detector 51 and the second detector 52. Likewise, the control device 50 may control the movement speeds of the upper flask 15, the lower flask 17 and the lower filling frame 41 using the detection results of the third detector 53, the fourth detector 54 and the fifth detector 55. For example, the control device 50 may reduce the movement speed by a predetermined value when detecting an approach to a target position (detecting a position within a predetermined distance from the predetermined position). According to such control, both of alleviation of the effect at the time of contact and reduction in the molding time of the upper mold and the lower mold can be achieved.

REFERENCE SIGNS LIST

1 . . . Flaskless molding machine, 12 . . . Guide, 15 . . . Upper flask, 16 . . . Upper flask cylinder, 17 . . . Lower flask, 18 . . . Lower flask cylinder, 19 . . . Match plate, 22 . . . Upper sand tank, 25 . . . Upper plate, 22*a*, 30*a* . . . Permeation member, 30 . . . First lower sand tank, 31 . . . Second lower sand tank, 32 . . . Lower tank cylinder, 35 . . . First communication port, 36 . . . First block plate, 37 . . . Squeeze cylinder, 38 . . . Second communication port, 39 . . . Second block plate, 40 . . . Lower plate, 41 . . . Lower filling frame, 42 . . . Lower filling frame cylinder, 50 . . . Control device, 44, 46 . . . Nozzle plate, 45, 47 . . . Block plate, 51 . . . First detector, 52 . . . Second detector, 53 . . . Third detector, 54 . . . Fourth detector, 55 . . . Fifth detector, 60 . . . Magnet, 61 . . . Magnetic field detecting portion, 70 . . . Recognition unit, 80 . . . Control unit, 90 . . . Storage unit.

The invention claimed is:

1. A flaskless molding machine forming a flaskless upper mold and lower mold, comprising:

an upper flask;

a lower flask disposed below the upper flask and capable of clamping a match plate with the upper flask;

an upper sand tank disposed above the upper flask, communicating with a compressed air source, being open at a lower end thereof, and internally storing mold sand;

an upper plate attached to a lower end of the upper sand tank, with at least one supply port being formed in the upper plate, the supply port allowing the upper sand tank to communicate with an inside of the upper flask;

a first lower sand tank communicating with a compressed air source, internally storing mold sand, and having a first communication port for discharging the stored mold sand;

a second lower sand tank disposed below the lower flask, being open at an upper end thereof, having a second communication port capable of communicating with the first communication port of the first lower sand tank, and storing the mold sand supplied from the first lower sand tank and to be supplied into the lower flask;

a lower plate attached to an upper end of the second lower sand tank, with at least one supply port being formed in the lower plate, the supply port allowing the second lower sand tank to communicate with an inside of the lower flask;

a drive unit configured to move the second lower sand tank in a vertical direction, and allowing the upper plate and the lower plate to perform squeezing;

an adjustment drive unit configured to move the first lower sand tank in the vertical direction;

a first detector configured to detect a height position of the first lower sand tank;

a second detector configured to detect a height position of the second lower sand tank; and a control unit configured to operate the drive unit and the adjustment drive unit so that the height positions of the first communication port and the second communication port coincide with each other, based on detection results of the first detector and the second detector.

2. The flaskless molding machine according to claim 1, wherein an upper molding space for molding the upper mold is formed by the upper plate, the upper flask and the match plate, and the upper molding space is filled with the mold sand stored in the upper sand tank, through the upper plate, and a lower molding space for molding the lower mold is formed by the lower plate attached to the second lower sand tank moved by the drive unit to a predetermined height, the lower flask and the match plate, a height of the first communication port of the first lower sand tank is adjusted by the adjustment drive unit to a communication position of the second communication port of the second lower sand tank to supply the mold sand stored in the first lower sand tank to the second lower sand tank, and the lower molding space is filled with the mold sand stored in the second lower sand tank, through the lower plate, and in a state where the upper molding space and the lower molding space are filled with the mold sand, the drive unit moves the second lower sand tank upward to perform squeezing between the upper plate and the lower plate.

3. The flaskless molding machine according to claim 2, further comprising a lower filling frame, wherein the lower molding space is formed by the lower plate, the lower flask, the lower filling frame and the match plate.

4. The flaskless molding machine according to claim 1, wherein the upper sand tank and the first lower sand tank are provided with permeation members each having a plurality of pores on an inner surface thereof, the pores allowing compressed air to flow.

5. The flaskless molding machine according to claim 1, further comprising a storage unit configured to store the height position of the first lower sand tank detected by the first detector at completion of a last squeeze and the height position of the second lower sand tank detected by the second detector at the completion of the last squeeze, as a last molding result, wherein the control unit determines the height position of the first lower sand tank and the height position of the second lower sand tank at a next sand filling time, based on the last molding result stored in the storage unit.

6. The flaskless molding machine according to claim 3, further comprising:

a third detector configured to detect a height position of the upper flask; and a fifth detector configured to detect a height position of the lower filling frame, wherein the upper plate has a fixed height position, and the control unit recognizes the thickness of the upper mold at a completion of squeeze based on the height position of the upper flask detected by the third detector at the completion of squeeze, and recognizes the thickness of the lower mold at the completion of squeeze based on the height position of the lower plate and the height position of the lower filling frame detected by the second detector and the fifth detector at the completion of squeeze, and determines the height position of the upper flask, the height position of the lower plate, the height position of the lower filling frame, the height position of the first lower sand tank, and the height position of the second lower sand tank at next sand filling time, based on the recognized thicknesses of the upper mold and the lower mold.

7. The flaskless molding machine according to claim 6, wherein the third detector comprises:

a magnet attached to the upper flask or a member moving together with the upper flask; and a detection portion attached to a fixed frame, consisting of a longitudinal member extending in the vertical direction, and configured to detect a magnetic field caused with the magnet.

8. The flaskless molding machine according to claim 6, wherein the fifth detector comprises:

a magnet attached to the lower filling frame or a member moving together with the lower filling frame; and a detection portion attached to a fixed frame, consisting of a longitudinal member extending in the vertical direction, and configured to detect a magnetic field caused with the magnet.

9. The flaskless molding machine according to claim 1, wherein the first detector comprises:

a magnet attached to the first lower sand tank or a member moving together with the first lower sand tank; and a detection portion attached to a fixed frame, consisting of a longitudinal member extending in the vertical direction, and configured to detect a magnetic field caused with the magnet.

10. The flaskless molding machine according to claim 1, wherein the second detector comprises:

a magnet attached to the second lower sand tank or a member moving together with the second lower sand tank; and a detection portion attached to a fixed frame, consisting of a longitudinal member extending in the vertical direction, and configured to detect a magnetic field caused with the magnet.

11. The flaskless molding machine according to claim 2, wherein the upper sand tank and the first lower sand tank are provided with permeation members each having a plurality of pores on an inner surface thereof, the pores allowing compressed air to flow.

12. The flaskless molding machine according to claim 3, wherein the upper sand tank and the first lower sand tank are provided with permeation members each having a plurality of pores on an inner surface thereof, the pores allowing compressed air to flow.

13. The flaskless molding machine according to claim 2, further comprising a storage unit configured to store the height position of the first lower sand tank detected by the first detector at completion of a last squeeze and the height position of the second lower sand tank detected by the second detector at the completion of the last squeeze, as a last molding result, wherein the control unit determines the height position of the first lower sand tank and the height position of the second lower sand tank at a next sand filling time, based on the last molding result stored in the storage unit.

14. The flaskless molding machine according to claim 3, further comprising a storage unit configured to store the height position of the first lower sand tank detected by the first detector at completion of a last squeeze and the height position of the second lower sand tank detected by the second detector at the completion of the last squeeze, as a last molding result, wherein the control unit determines the height position of the first lower sand tank and the height position of the second lower sand tank at a next sand filling time, based on the last molding result stored in the storage unit.

15. The flaskless molding machine according to claim 4, further comprising a storage unit configured to store the height position of the first lower sand tank detected by the first detector at completion of a last squeeze and the height position of the second lower sand tank detected by the second detector at the completion of the last squeeze, as a last molding result, wherein the control unit determines the height position of the first lower sand tank and the height position of the second lower sand tank at a next sand filling time, based on the last molding result stored in the storage unit.

16. The flaskless molding machine according to claim 7, wherein the fifth detector comprises:

a magnet attached to the lower filling frame or a member moving together with the lower filling frame; and a detection portion attached to a fixed frame, consisting of a longitudinal member extending in the vertical direction, and configured to detect a magnetic field caused with the magnet.

17. The flaskless molding machine according to claim 2, wherein the first detector comprises:

a magnet attached to the first lower sand tank or a member moving together with the first lower sand tank; and a detection portion attached to a fixed frame, consisting of a longitudinal member extending in the vertical direction, and configured to detect a magnetic field caused with the magnet.

18. The flaskless molding machine according to claim 3, wherein the first detector comprises:

a magnet attached to the first lower sand tank or a member moving together with the first lower sand tank; and a detection portion attached to a fixed frame, consisting of a longitudinal member extending in the vertical direction, and configured to detect a magnetic field caused with the magnet.

19. The flaskless molding machine according to claim 4, wherein the first detector comprises:

a magnet attached to the first lower sand tank or a member moving together with the first lower sand tank; and a detection portion attached to a fixed frame, consisting of a longitudinal member extending in the vertical direction, and configured to detect a magnetic field caused with the magnet.

20. The flaskless molding machine according to claim 5, wherein the first detector comprises:

a magnet attached to the first lower sand tank or a member moving together with the first lower sand tank; and a detection portion attached to a fixed frame, consisting of a longitudinal member extending in the vertical direction, and configured to detect a magnetic field caused with the magnet.

* * * * *